US008061478B2

(12) United States Patent
Drouin

(10) Patent No.: US 8,061,478 B2
(45) Date of Patent: Nov. 22, 2011

(54) ACOUSTIC FACE OF POLYMER AND EMBEDDED COARSE AGGREGATES AND AN ACOUSTIC PANEL ASSEMBLY

(75) Inventor: Jean Drouin, Sherbrooke (CA)

(73) Assignee: Moderco Inc., Boucherville (CA)

( * ) Notice: Subject to any disclaimer, the term of this patent is extended or adjusted under 35 U.S.C. 154(b) by 0 days.

(21) Appl. No.: 12/436,643

(22) Filed: May 6, 2009

(65) Prior Publication Data

US 2009/0277717 A1 Nov. 12, 2009

Related U.S. Application Data

(60) Provisional application No. 61/071,573, filed on May 6, 2008.

(51) Int. Cl.
*E04B 1/00* (2006.01)
*E04B 1/82* (2006.01)
*E04B 1/84* (2006.01)

(52) U.S. Cl. ..... 181/294; 181/285; 181/290

(58) Field of Classification Search ..... 181/294, 181/285, 290
See application file for complete search history.

(56) References Cited

U.S. PATENT DOCUMENTS

| | | | | |
|---|---|---|---|---|
| 2,198,885 | A | | 4/1940 | Price |
| 3,079,277 | A | | 2/1963 | Painter |
| 3,357,516 | A | | 12/1967 | Cadotte et al. |
| 3,424,270 | A | | 1/1969 | Hartman et al. |
| 3,489,242 | A | | 1/1970 | Gladding et al. |
| 3,894,169 | A | | 7/1975 | Miller |
| 3,904,456 | A | | 9/1975 | Shwartz |
| 4,014,137 | A | | 3/1977 | Williams et al. |
| 4,056,161 | A | | 11/1977 | Allen, Jr. |
| 4,084,366 | A | | 4/1978 | Saylor et al. |
| 4,084,367 | A | * | 4/1978 | Saylor et al. ..... 428/113 |
| 4,094,380 | A | * | 6/1978 | Kobayashi et al. ..... 181/285 |
| 4,103,463 | A | * | 8/1978 | Dixon ..... 52/126.4 |
| 4,222,785 | A | * | 9/1980 | Henderson ..... 106/698 |
| 4,277,920 | A | * | 7/1981 | Dixon ..... 52/64 |
| 4,278,726 | A | | 7/1981 | Wieme |
| 4,464,428 | A | | 8/1984 | Ebert et al. |
| 4,585,685 | A | * | 4/1986 | Forry et al. ..... 428/143 |
| 4,856,248 | A | | 8/1989 | Larson et al. |

(Continued)

FOREIGN PATENT DOCUMENTS

CA 2516133 A1 2/2006

(Continued)

OTHER PUBLICATIONS

Excentricities, Giorgione Stone Finish (Available at http://www.excentricities.co.za/product.htm.

(Continued)

*Primary Examiner* — Lincoln Donovan
*Assistant Examiner* — Christina Russell
(74) *Attorney, Agent, or Firm* — Baker & Hostetler LLP

(57) ABSTRACT

Described is an acoustic face comprising a solid polymer resin and coarse aggregates embedded within the solid polymer resin, and an acoustic panel assembly comprising at least one frame with a central opening in which a pair of the acoustic faces are mountable in opposed and spaced-apart relation to each other. The coarse aggregates of the acoustic face and panel assembly enable the acoustics to benefit highly from the mass law, efficient manufacturing and cost savings on materials.

31 Claims, 17 Drawing Sheets

U.S. PATENT DOCUMENTS

| | | | | |
|---|---|---|---|---|
| 4,985,106 | A | 1/1991 | Nelson | |
| 5,400,296 | A * | 3/1995 | Cushman et al. | 367/1 |
| 5,430,070 | A * | 7/1995 | Kono | 521/69 |
| 5,631,075 | A * | 5/1997 | Ishikawa et al. | 428/221 |
| 5,641,950 | A * | 6/1997 | Kotter | 181/285 |
| 5,683,799 | A | 11/1997 | Olinger | |
| 5,709,053 | A * | 1/1998 | Kuroda | 52/145 |
| 5,765,334 | A * | 6/1998 | Vitous | 52/745.19 |
| 5,890,323 | A | 4/1999 | Errato | |
| 6,290,181 | B1 | 9/2001 | Gadd et al. | |
| 6,443,257 | B1 * | 9/2002 | Wiker et al. | 181/290 |
| 6,443,258 | B1 | 9/2002 | Putt et al. | |
| 6,576,333 | B2 | 6/2003 | Sheng et al. | |
| 6,700,304 | B1 | 3/2004 | Fuller et al. | |
| 6,729,094 | B1 * | 5/2004 | Spencer et al. | 52/414 |
| 6,743,830 | B2 * | 6/2004 | Soane et al. | 521/83 |
| 6,780,356 | B1 | 8/2004 | Putt et al. | |
| 6,855,398 | B1 | 2/2005 | Machino et al. | |
| 6,958,567 | B2 | 10/2005 | Fuller et al. | |
| 7,343,715 | B2 * | 3/2008 | Ito et al. | 52/309.16 |
| 7,573,177 | B2 | 8/2009 | Fuller et al. | |
| 2004/0045234 | A1 * | 3/2004 | Morgan et al. | 52/232 |
| 2004/0115415 | A1 | 6/2004 | Thiele et al. | |
| 2004/0126557 | A1 | 7/2004 | Thiele et al. | |
| 2005/0042437 | A1 | 2/2005 | Ramesh et al. | |
| 2006/0131103 | A1 | 6/2006 | Fuller et al. | |
| 2007/0056481 | A1 * | 3/2007 | Gray | 106/819 |
| 2007/0125011 | A1 * | 6/2007 | Weir et al. | 52/144 |
| 2007/0193143 | A1 * | 8/2007 | Antonic | 52/241 |
| 2007/0227814 | A1 | 10/2007 | Schabel, Jr. | |
| 2008/0176967 | A1 * | 7/2008 | Bui | 521/56 |

FOREIGN PATENT DOCUMENTS

| | | | |
|---|---|---|---|
| EP | 0690182 | B1 | 3/1996 |
| FR | 2272456 | A1 | 12/1975 |
| FR | 2375400 | A1 | 7/1978 |
| GB | 1557318 | A | 12/1979 |
| GB | 2382816 | A | 6/2003 |
| WO | 8902961 | A1 | 4/1989 |
| WO | 9415766 | A1 | 7/1994 |
| WO | 9420703 | A1 | 9/1994 |
| WO | 9830375 | A1 | 7/1998 |
| WO | 2005075758 | A1 | 8/2005 |
| WO | 2006131138 | A1 | 12/2006 |

OTHER PUBLICATIONS

Moris, Beverly, Acoustic Wall Board (Available at www.librisdesign.org/docs/LibraryIntFinMat.doc.

* cited by examiner

ACOUSTIC FACE OF POLYMER AND EMBEDDED COARSE AGGREGATES AND AN ACOUSTIC PANEL ASSEMBLY

CROSS-REFERENCE TO RELATED APPLICATIONS

This application claims priority to U.S. Provisional Patent Application Ser. No. 61/071,573, filed on May 6, 2008, and entitled "An Acoustic Panel, a Wall Assembly and a Composition of Polymer and Embedded Aggregates," the disclosure of which is incorporated herein by reference in its entirety.

FIELD OF THE INVENTION

The present invention generally relates to the field of acoustics and more specifically to acoustic faces and panel assemblies for creating a sound barrier.

BACKGROUND OF THE INVENTION

Acoustic walls and barriers block sound waves from traversing from one side to the other. Acoustic walls can block sound waves by various mechanisms. First, by providing a massive wall the sound can be reflected or scattered to prevent it from traversing to the other side. Second, a wall can be made to have particular vibration and resonance properties to attenuate the sound waves by absorbing them.

In the field, acoustic panels have been constructed using various types of materials. For instance, one type of acoustic panel has used gypsum-steel faces, wherein each face is composed of a gypsum board and a steel sheet secured to each other. The faces are mounted in spaced relation to each other in a frame and often rock wool is provided in the gap between the spaced faces. Such acoustic panels often have an acoustic performance of about 53 STC. The increasing cost of primary materials, particularly steel, has rendered this known configuration relatively expensive.

Some known acoustic articles have been composed of a matrix material with small embedded particles to provide acoustic properties. Matrix materials have been cementitious materials such as concrete or polymers. The particles incorporated in the matrix have been to a large extent in powder form and have been made of materials such as lead, barium, iron, glass, silicone or sand.

Some powder-containing compositions have been used to provide lightweight acoustic articles that can absorb certain frequencies of structural vibration or sound waves. Most powders or particles have been used in relatively low weight percentage in relation to the weight of the overall composition.

Incorporating powders or fine particulate materials into a matrix has various disadvantages. For instance, fine material may tend to clump or stick to vessels during handling and manufacturing, which reduces efficiency and makes it more difficult to consistently and evenly distribute the material in the matrix. This can result in reduced reliability in the final product. It may also be difficult to incorporate a high mass percentage of fine material consistently into the matrix, particularly when even distribution is desired.

Principles of Acoustic Transmission Loss

Transmission loss is an acoustic indicator and is governed by certain principles particularly in relation to single- and multiple-face configurations.

Single Panels

The transmission loss of a single face is characterized by three zones:

1) Mass law. At low frequencies the transmission loss of a single face is governed by the mass law, which can be represented by the following formula:

$$R = 20\log\left(\frac{m\omega}{2\rho_0 c}\right)$$

where R is the attenuation, m is the surface density of the panel, $\omega=2\cdot\pi\cdot f$ is the frequency, $\rho_0$ is the density of the air and c is the wave velocity of the sound in the air.

This relationship indicates that by doubling the surface density leads to an increase in the transmission loss of 6 dB. The transmission loss increases linearly with the frequency according to a slope of 6 dB per octave.

2) Critical frequency. The critical frequency is characterized by a marked decrease in the acoustic efficiency of the face. At this frequency, the wave velocity in the face is equal to the wave velocity in the surrounding fluid medium. This phenomenon optimizes the acoustic energy transfer into vibrational energy and therefore decreases the efficiency of the face. The value of the critical frequency depends on the deflection rigidity of the panel and the propagation conditions in the surrounding fluid. In practice, the critical frequency is calculated with the following formula:

$$f_c = \frac{c^2}{2\pi}\sqrt{\frac{m}{D}} = \frac{c^2}{2\pi}\sqrt{\frac{12\rho_s(1-v^2)}{Eh^2}}$$

where $f_c$, is the critical frequency;

c, is the wave velocity in the fluid environment;

m, is the surface density;

D, is the deflection rigidity of the material;

$\rho_s$, is the surface density of the face;

v, is the Poisson coefficient of the face;

E, is the Young's modulus of the face;

h, is the thickness of the face.

3) Stiffness-governed transparency. At high frequencies, above the critical frequency, the transparency of the face depends principally on its stiffness. Increasing the transmission loss is achieved at a slope of 12 dB per octave.

Double-Panel Configuration

The transmission loss of a double-panel is characterized by three different zones.

1) At low frequencies, the transmission loss presents a singularity with a significant drop in value. This singularity may be called the "respiration frequency" of the double-face and is evaluated by the following formula:

$$f_{dp} = \frac{1}{2\pi}\sqrt{\frac{\rho\cdot c^2}{d}\left(\frac{1}{m_1}+\frac{1}{m_2}\right)}$$

where $f_{dp}$, is the respiration frequency of the double-face;

ρ, is the fluid density;

c, is the wave velocity in the fluid environment;

$m_i$, is the surface density of the first (1) or second (2) face;

d, is the distance between the faces.

2) At medium frequencies, the transmission loss of the double-face is governed by the acoustic resonance in the cavity between the two faces. These resonances can be eliminated by employing an absorbent material in the cavity.

3) At high frequencies, the phenomena of critical frequencies arise for each of the two faces.

Known acoustic faces and panel assemblies present a variety of disadvantages such as using expensive materials, being relatively light which hampers their sound blocking ability, being difficult or inefficient to manufacture and/or containing compounds that may be toxic or present other drawbacks.

There is a need in the field of acoustics for a technology that overcomes at least one of the disadvantages of known acoustic faces and panel assemblies.

SUMMARY OF THE INVENTION

The present invention responds to the above-mentioned need by providing an acoustic face and an acoustic panel assembly.

Accordingly, embodiments of the present invention provide an acoustic panel including a solid polymer resin and coarse aggregates embedded within the solid polymer resin.

Embodiments of the present invention also provide an acoustic panel assembly. The acoustic panel assembly includes at least one frame defining a central opening and a pair of acoustic panels as defined above or herein below, mountable in opposed and spaced-apart relation to each other within the central opening of each frame.

The coarse aggregates of the acoustic face and panel assembly enable the acoustics to benefit highly from the mass law, efficient manufacturing and cost savings on materials.

DETAILED DESCRIPTION

Embodiments of the acoustic face and panel assembly will now be further described in relation to the Figures.

Acoustic Face

Figure 1:
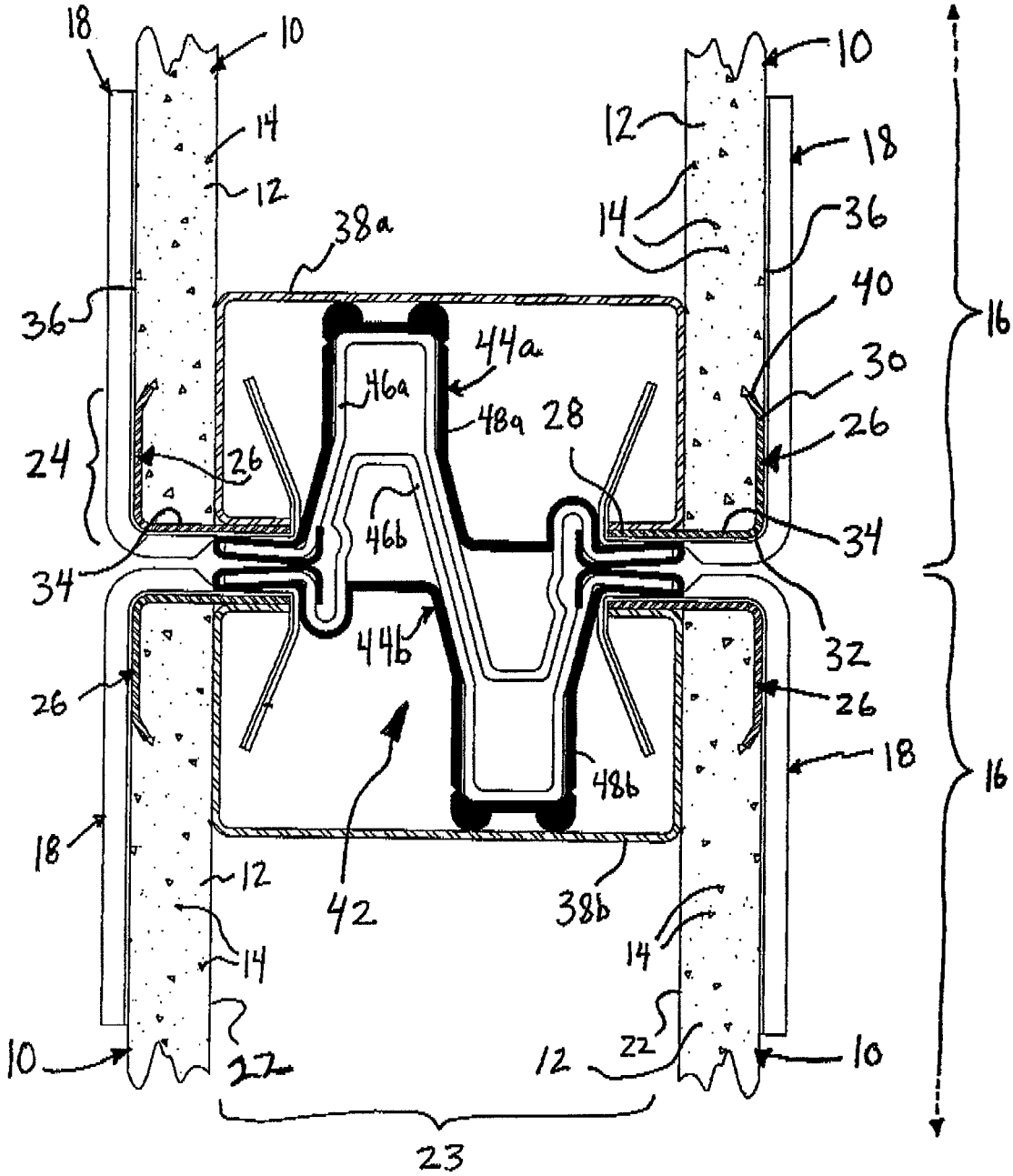
FIG. 1 is a top cross-sectional plan view of part of two panel assemblies, including parts of mounted faces, according to one embodiment of the present invention.
Figure 5:
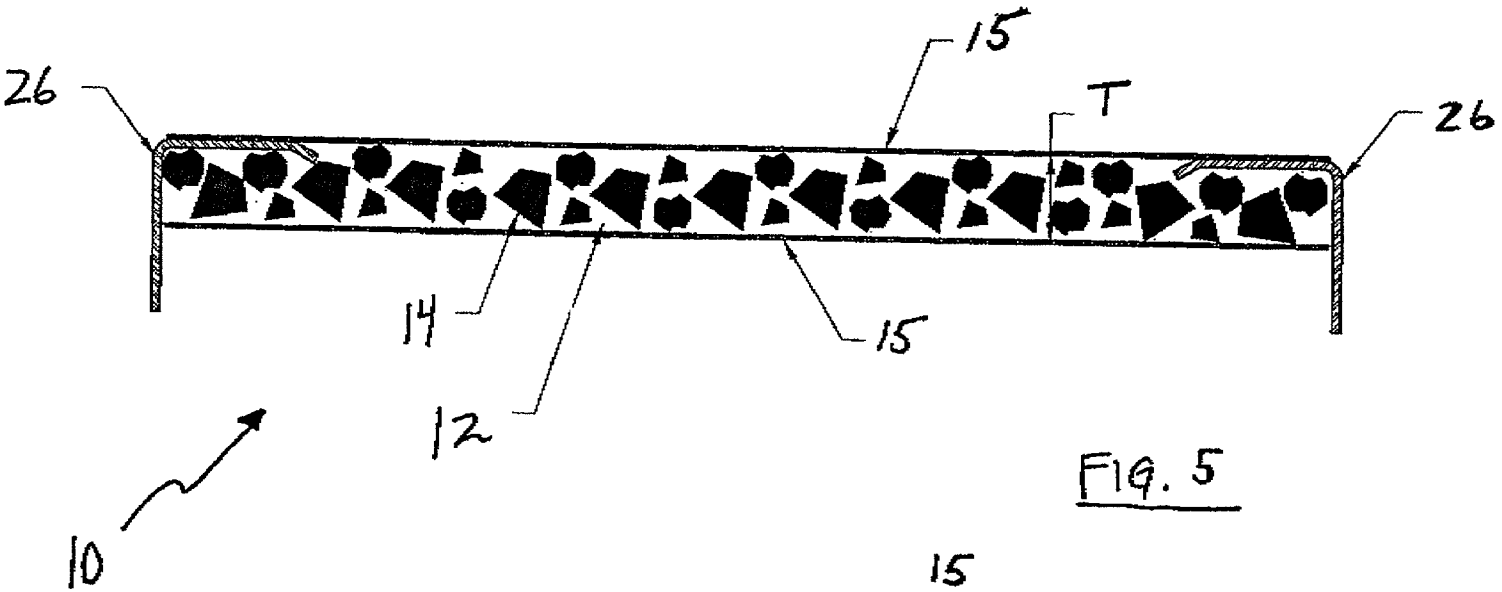
FIG. 5 is a side cut view of an acoustic panel with embedded angle bars, according to one embodiment of the present invention.
Figure 4:
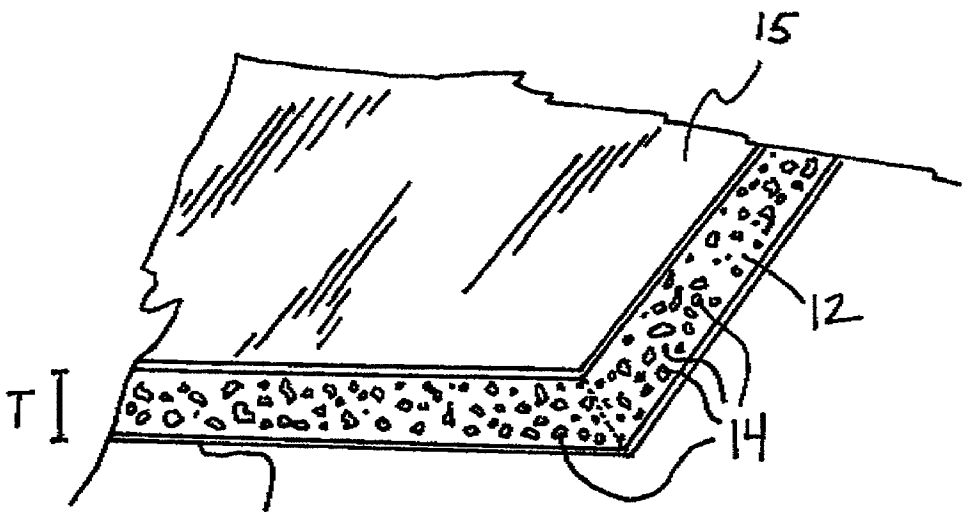
FIG. 4 is a top perspective view of part of a panel and its cardboard covering, according to an embodiment of the present invention.

Referring to FIGS. 1, 4 and 5, an acoustic face 10 according to preferred embodiments of the present invention is illustrated. The face 10 includes a solid polymer resin 12 and coarse aggregates 14 embedded within the polymer resin 12.

The acoustic face 10 benefits from the mass law to provide a heavy barrier to block sound transmission from one space to another. The coarse aggregates 14 enable a increase in the total mass of the face 10 and thereby increase the acoustic sound blockage.

"Coarse aggregates" 14 means aggregates that have a particle size of at least about 3 mm and can be embedded within the polymer resin while allowing the polymer resin to solidify into a face shape. Thus, the "coarse aggregates" exclude "coarse sand", which generally denotes particle sizes of 1-2 mm and finer aggregates such as medium sand, fine sand, silt and clay. Since aggregate nomenclature varies from jurisdiction to jurisdiction, "coarse aggregates" will be understood as per the above general definition. In many embodiments of the present invention, the coarse aggregates may be referred to as fine or medium pebbles, meaning that they have a particle size between about 4 mm and about 20 mm, and still preferably the coarse aggregates may have a particle size of at most about 13 mm, especially for applications in faces for mobile partitions. The surface area and surface properties of the coarse aggregates allow the polymer resin to secure them sufficiently to avoid excessive crumbling of the polymer resin or detachment of the aggregates, while allowing the aggregates to be incorporated into the face in a high weight percentage.

The "solid polymer resin" 12 may be a variety of polymers suitable for having aggregates embedded therein. In one optional aspect of the polymer resin, it is a foam-type polymer such as polyurethane that may be produced by reacting a polyol with an isocyanate. In this context, "solid" means that the polymer resin is in a solidified state and it may have varying degrees of rigidity and flexibility.

In the embodiment of FIG. 4, the solid polymer resin 12 is polyurethane and the coarse aggregates 14 are stones that are present in over 95 wt % relative to the overall weight of the face 10. The face may also be made so that the coarse aggregates 14 are present in over 80 wt % relative to the overall weight of the face 10. The coarse aggregates 14 preferably have a density that is greater than the density of the polymer resin. The coarse aggregates 14 may be marble, granite, limestone or various quarry stones, or a mixture thereof. The coarse aggregates 14 may be artificially crushed to the desired particle sizes or be naturally occurring. Often the coarse aggregates 14 will be obtained according to the current prices and availability.

The coarse aggregates 14 are sized to enable high weight percentage within the face to improve the acoustics, increased inter-aggregate permeability for liquid resin flow, sufficient outer surface area and properties to allow adherence between the resin and the aggregates, easy handling prior to and during manufacturing, low material costs, and other advantages over fine particles and powders.

The coarse aggregates 14 may have a particle size between about 3 mm and about 13 mm. It may be preferred to have aggregates with a maximum particle size being about the same as the thickness of the face 10. Thus, when ½ inch (corresponding to about 12.7 mm) faces are manufactured, the particle size of the aggregates may be about 12.7 mm. Optionally, the coarse aggregates 14 may have a range of different sizes within the distribution, for instance between about 3 mm and about 13 mm, allowing the smaller aggregates to advantageously partially fill the gaps in between larger aggregates to increase the overall amount of coarse aggregates 14 in the face 10 and normalize the interstitial space in between the aggregates filled within polymer resin. Providing a distribution of different particle sizes allows improved manufacturing and also allows the face to have improved weight and flexibility for ameliorated acoustic performance. Having aggregates with different particle sizes ranging between about 3 mm and about 13 mm is preferred.

In addition to the coarse aggregates 14, there may be a small amount of residual aggregate powder. When rough gravel is used, there is often a small amount of gravel dust or powder along with the bulk coarse aggregates 14.

The coarse aggregates 14 may be distributed randomly and evenly within the polymer resin 12. This may be accomplished by pouring and spreading the coarse aggregate 14 over the interior surface of a mold (not shown) and then evenly introducing the liquid polymer resin 12 across the mold.

In accordance with various embodiments of the present invention, the face 10 may be manufactured by spreading the coarse aggregates 14 over a surface of a mold and then introducing the polyurethane 12 in liquid or flowable form into the mold. Thus, the aggregates 14 may be embedded within the polymer resin 12 when it is in a liquid or flowable form before it is cured. Prior to distributing the aggregates 14, the mold may be preheated in its entirety. Optionally, the polyurethane is provided so that when the face 10 is produced the cured polyurethane is a rigid foam. Various foaming agents and other additives may be used in manufacturing the face 10. The constituents of the face 10 may be integrally formed together into the desired shape to make an integral one-piece face 10.

The acoustic face 10 may be sized to have dimensions enabling it to be used in domestic or industrial applications to form a sound barrier between two spaces, such as a mobile partition.

Referring to FIG. 4, the thickness T of the face may be, for instance, about ⅜ inch to about 1 inch, preferably from about ⅜ inch to about ¾ inch. The face may also have a length of about 24 inches to about 54 inches, and a width of about 1 foot to about 30 feet. It should be understood that the face may have a variety of other dimensions and forms according to different designs and applications.

Referring to FIG. 4, the aggregates 14 are preferably distributed throughout the polymer resin 12 of the face. Preferably, they are distributed evenly over the surface area and the thickness T of the face 10. The coarseness of the coarse aggregates, i.e. their particle size(s), allows improved pouring, spreading and distributing over the surface of the mold and increases the interstitial permeability for the liquid resin which can flow between the inter-aggregate gaps and generally surrounding each coarse aggregate particle, thereby increasing manufacturing efficiency and solidity of the eventual acoustic face 10. Even distribution of the aggregates 14 also increases the amount of aggregates 14 that can be embedded within the polymer resin 12. Even distribution of the aggregates also allows increased mass of the overall face and improved integrity and solidity of the face.

Referring still to FIG. 4, the face 10 may also be provided with a covering 15, which may be composed of a paper-based material such as cardboard, a sheet of steel, plastic, wood or another type of finish that may be chosen by an end user, such as carpet or vinyl. The covering 15 is preferably a uniform one-piece sheet that increases the structural integrity of the surface of the polymer-aggregate face 10. The covering 15 may be mounted to the face 10 after curing by means of an adhesive. The covering 15 may be provided over the opposed flat surfaces of the face 10, as illustrated, although other parts of the face 10 may be covered if desired. The covering 15 improves the smoothness and the handling ability of the face 10 for facilitating installation or assembly with other components. It may also provide an aesthetic appearance to the face if desired.

In one optional embodiment of the face 10, the aggregates 14 are distributed in a generally random and symmetrical fashion within the polymer resin. The distribution may be "symmetrical" over the entire surface and/or the thickness T of the face 10.

Alternatively, the coarse aggregates 14 may be distributed in an asymmetrical fashion in order to offer different or tailored acoustic behavior and performance. An asymmetrically distributed face 10 may present superior acoustic performance, by displacing or eliminating specific resonance frequency ranges for the acoustic face 10 or panel assembly and thus reducing the required overall weight of the face(s) 10.

Acoustic Panel Assembly

Figure 2:
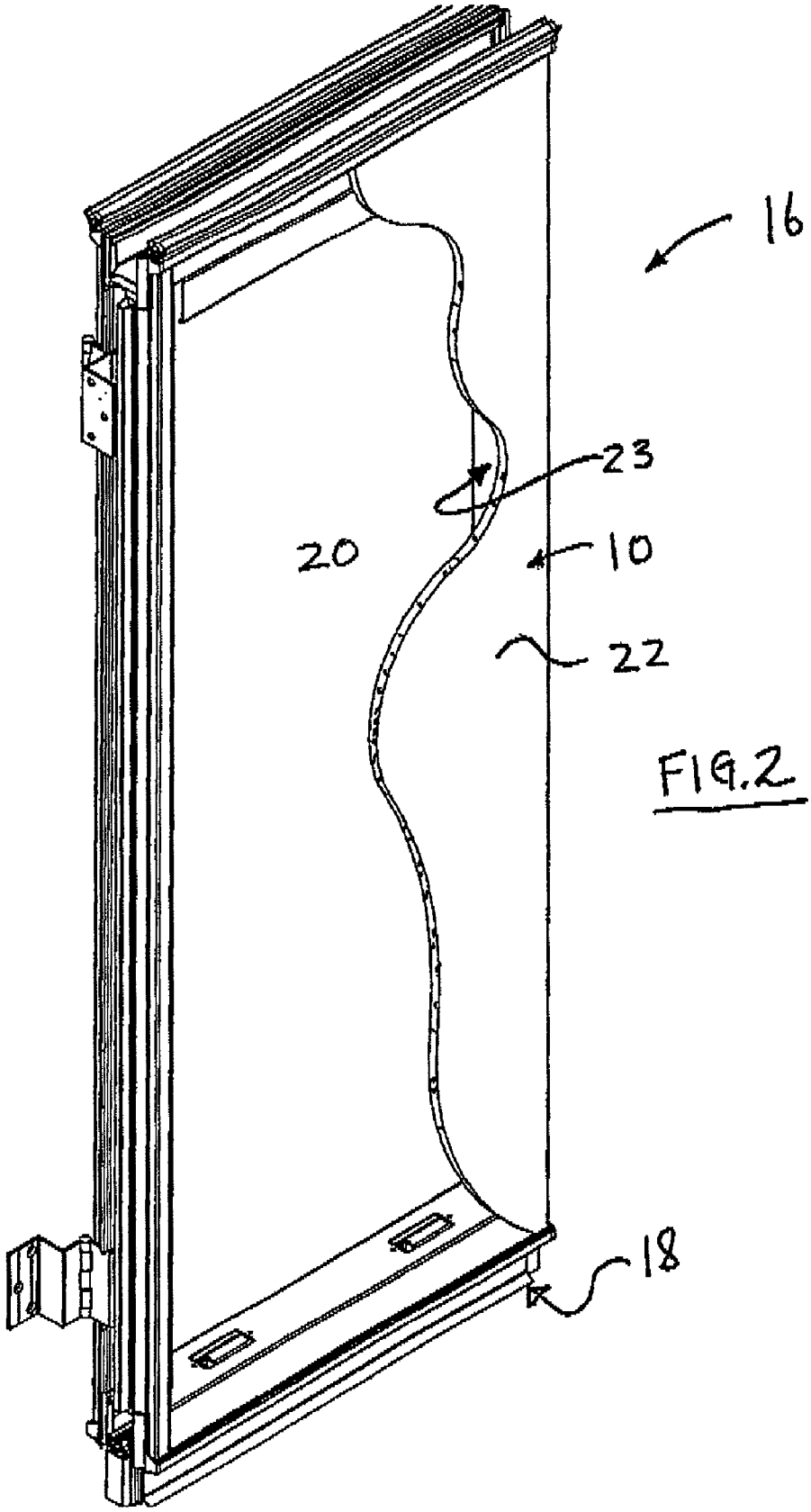
FIG. 2 is a top perspective partial transparent view of a panel assembly, according to an embodiment of the present invention.
Figure 3:
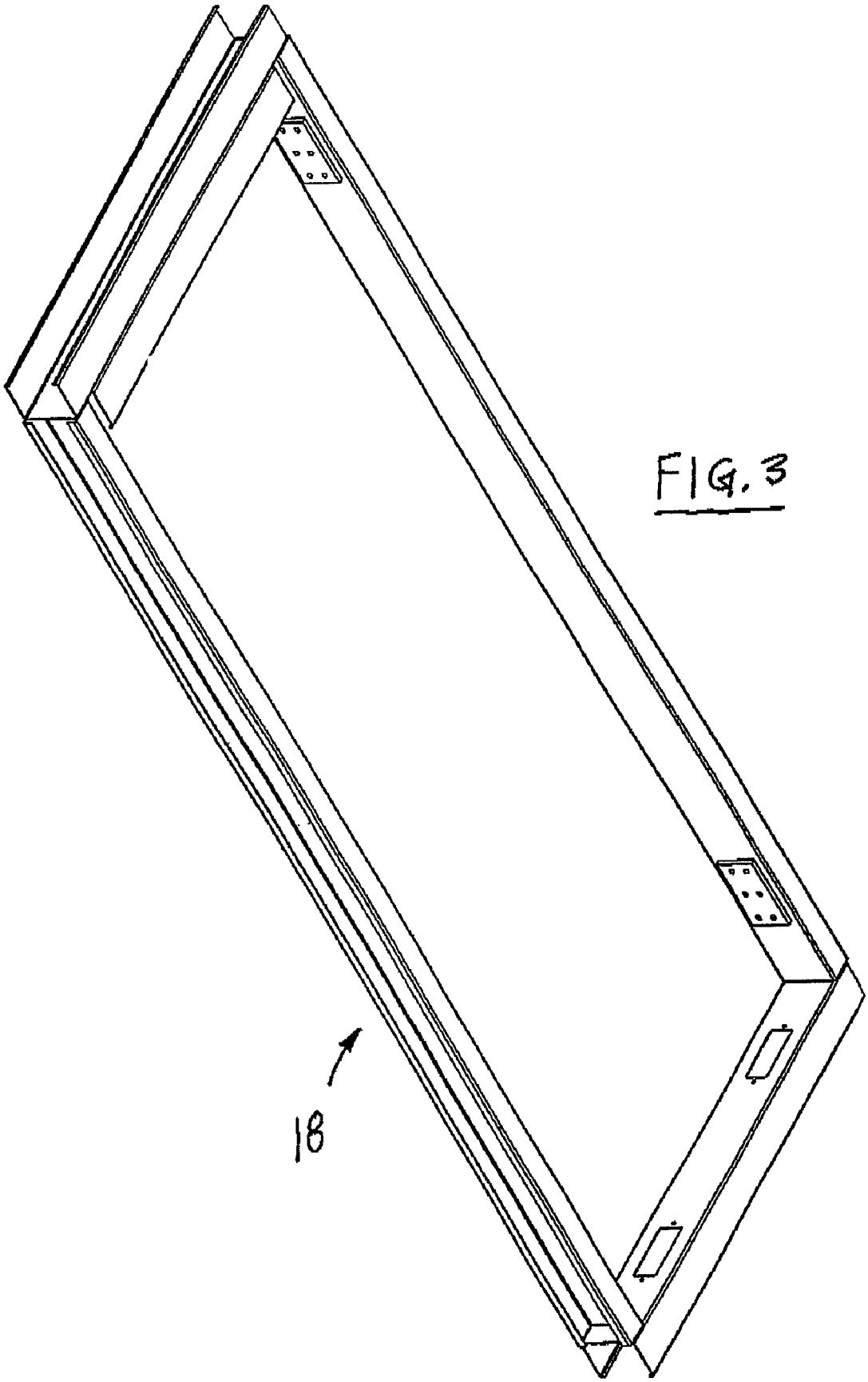
FIG. 3 is a perspective view of a frame for an embodiment of the panel assembly.

Referring to FIG. 2, an embodiment of an acoustic panel assembly 16 is illustrated.

This embodiment of the acoustic panel assembly 16 includes a frame 18 defining a central opening 20 and acoustic faces 10 having flat surfaces 22 and edges (not illustrated here). The frame 18 may be composed of metal, such as aluminium or steel. Alternatively, the frame 18 could be made of rigid plastic or a mixture of materials. The acoustic faces 10 are mounted within the frame 18 to preferably completely cover the central opening 20 and so that the flat surfaces 22 of opposed faces are space-apart to define a region 23 therebetween. Preferably, the two faces 10 are in parallel relation as well.

There may be mineral wool (not shown), such as rock wool, provided in the region 23 between the two acoustic faces 10. The mineral wool provides additional acoustic performance, particularly at certain frequencies.

It should be noted that the region 23 is an element that allows additional acoustic ability. The region 23 may be filled with wool that absorbs some of the sound transmitted beyond the first face. However, when the faces 10 of the present invention are used in a panel assembly 16, the region may be empty and the absorption of sound thus occurs principally via the faces themselves. Since the faces 10 are composed of distributed aggregates, which vibrate at a certain frequency in response to impinging sound, as well as polymer resin, which vibrates at another frequency in response to the sound and by being in direct contact with the aggregates, the faces are able to absorb sound waves. The region allows the transmission frequency to be broken from one face's surface to the other. When there is no wool and only air present in the region 23, the polymer resin part of the face, in combination with the distributed aggregates which themselves are not in direct contact, acts as an absorber similarly as the wool would have done to reduce the amount of resonance between the faces. Thus, the faces mounted in spaced relation combine the effects of the mass law with sound absorption capabilities.

Referring to FIG. 1, each of the two acoustic faces 10 may be secured within the corresponding frame 18 by a securing mechanism 24. The securing mechanism 24 may include a connector 26 with first 28 and second 30 sides, which are preferably joined by a bend 32 to thereby have an L-shape. In such a construction, the connector 26 may also be called an "angle bar". The first side 28 is preferably provided along an edge 34 of the face 10 and the second side 30 extends along a flat outward-facing surface 36 of the face 10. Preferably, the angle bar connector 26 follows the contours of the face 10 along part of the flat surface 36 and the edge 34. In the illustrated embodiment of FIG. 1, the first side 28 is connected to the frame 18 by spot welding to parts of the frames 18 including inner spacer elements 38*a*,38*b*. The second side 30 is connected to the face 10 by being embedded within the face 10. In this case, the second side 30 of the connector 26 is embedded within the face 10 when the resin 12 is still in flowable or liquid state, before curing. The second side 30 may also include at its extremity an anchor element 40. The anchor element 40 improves the embedded connection of the connector 26 within the face 10. The anchor element 40 may be a one-piece portion of the second end 30 itself and may extend inward at about a 45° angle relative to the rest of the second side 30. The anchor element 40 may also take other forms such as curved or hooked and may extend at other angles to enable connection with the face 10.

Referring still to FIG. 1, two interconnected panel assemblies 16 are partially illustrated. It should be understood that panel assemblies 16 may be constructed to have standard sizes and may then be adapted to particular acoustic applications by being interconnected together to form a multiple-panel partition, which may be modular. As shown in FIG. 1, two panel assemblies 16 are interconnected in coplanar relation by a mounting mechanism 42. The mounting mechanism 42 may be constructed in a variety of ways to enable the panel assemblies 16 to be fixedly or removably mounted together.

In the embodiment of FIG. 1, the mounting mechanism 42 includes two corresponding connection assemblies 44*a*,44*b*. Each of the connection assemblies 44*a*,44*b* is mounted to a corresponding spacer element 38*a*,38*b*, optionally with screws. The connection assemblies are preferably identical and fit together to allow an acoustic connection between adjacent panel assemblies 16.

Referring still to FIG. 1, each connection assembly 44*a*, 44*b* includes an alignment member 46*a*,46*b* and a sealing member 48*a*,48*b*. The alignments members 46*a*,46*b* are preferably composed of a rigid material such as aluminium and allow the connection assemblies to be aligned and fit together. Preferably, the alignment members 46*a*,46*b* have corresponding projections and recesses, which may result from an undulating shape, to fit together in a male-female fashion. This shape also creates a circuitous route for any sound propagation which baffles sound and thus reduces sound propagation. The sealing members 48*a*,48*b* preferably act as dampeners and as a seal between the panel assemblies 16. The sealing members 48*a*,48*b* may be composed of a plastic material. When the sealing members 48*a*,48*b* come into contact with each other, they compress the plastic material to seal the joint in between the panel assemblies 16. The sealing members 48*a*,48*b* are preferably mounted to the spacer element 38 via screws arranged every twelve inches along the length of the spacer 38.

It should also be noted that the composition used to make the acoustic face may also be used to make other articles having a variety of forms for acoustic applications. Preferably, the form is adapted for the desired application. For instance, walls, floors and ceilings, which are interior or exterior, may be made with the composition. The composition is preferably provided in a one-piece integral form, as is the case in the example of the faces 10 described herein. The composition may be molded into a form for a specific application, and may thus be curved, undular, straight, elongated, flat or another shape. The composition may also be used for forming products in various industries, when relatively heavy acoustic products are desirable. In one optional aspect of the composition, when a particular form is to be produced it may be done in a mold for that purpose rather than by simple cutting or breaking. Since the composition has embedded aggregates that are preferably evenly distributed throughout the polymer resin, it may be difficult to accurately cut or break it into the desired form once the composition has been cured. Alternatively, adequate cutting equipment could be provided to cut the through the aggregates and the solid polymer resin of the composition into the desired form.

Simulations and Examples

Several simulations and experiments were performed to evaluate embodiments of the acoustic face and panel assembly.

Simulations

Various simulations were performed on known and proposed new acoustic faces and panel assemblies.

Figure 6:
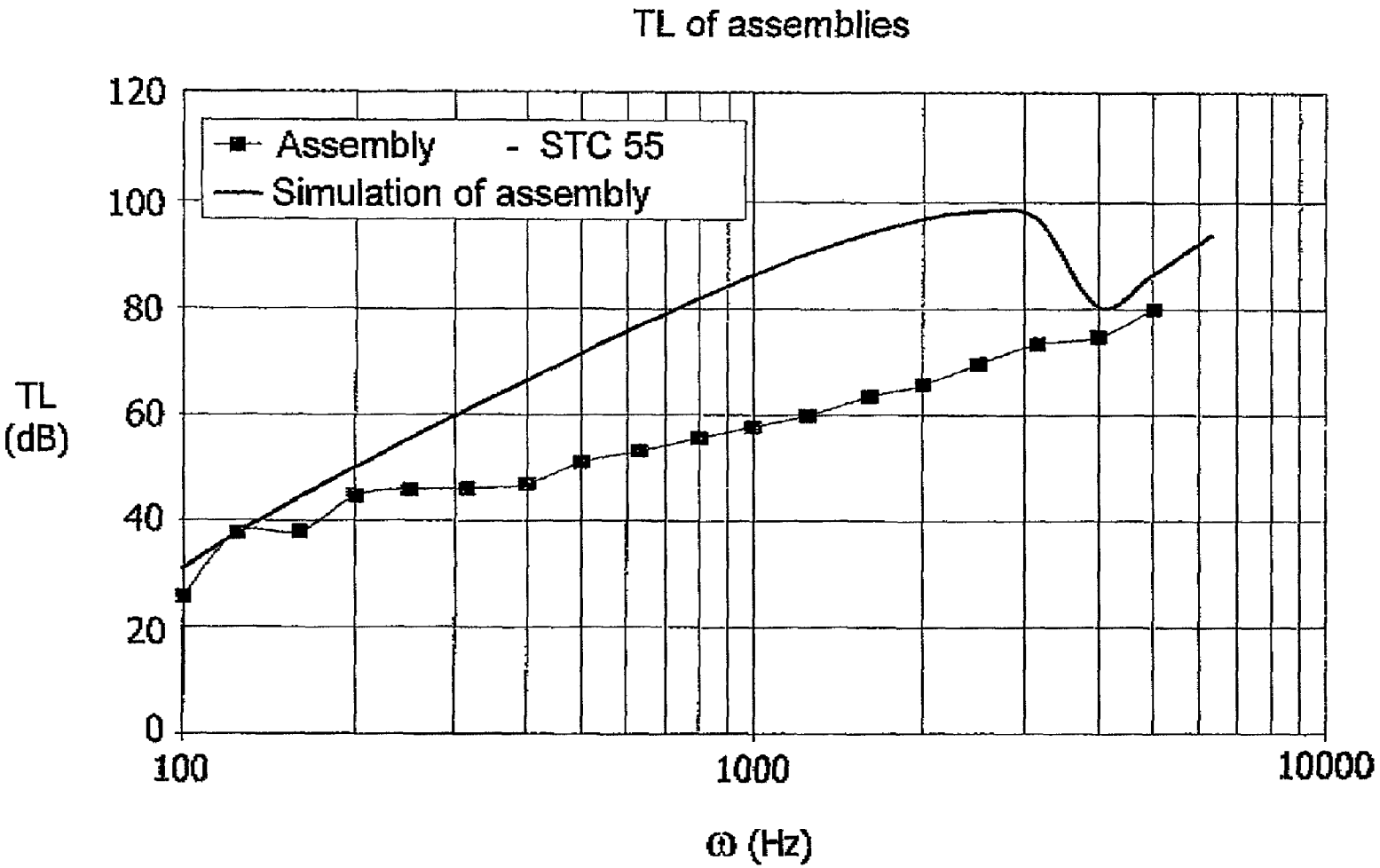
FIG. 6 is a graph of transmission loss versus frequency for a known acoustic panel assembly, comparing simulation and experimental data.

FIG. 6 shows experimental and simulation results for a traditional gypsum-steel panel assembly. This assembly was composed of two ½ inch gypsum sheets, four 0.030 inch steel sheets, 2.5 inches of Roxul XFL 80 wool, within a metal frame. The simulation was numerical and was performed by the software NOVA developed by Mecanum Inc. To perform the simulation, it was necessary to characterize the physical and acoustic properties of the constituent materials of the panel assembly (e.g. porosity, air passage resistance, tortuosity, viscous and thermal properties, density, Young's modulus, Poisson coefficient, loss factor).

It is observed that the numerical simulation overestimates the transmission loss (TL), essentially because it does not take into account the transmission passageways and the vibratory effects of the aluminum frame of the panel assembly. This simulation nevertheless was able to lead to ameliorations in the assembly. One such amelioration in the acoustic performance was the modification of the constitution of the assembly by comparing the materials of faces that make up an acoustic panel assembly.

Figure 7:
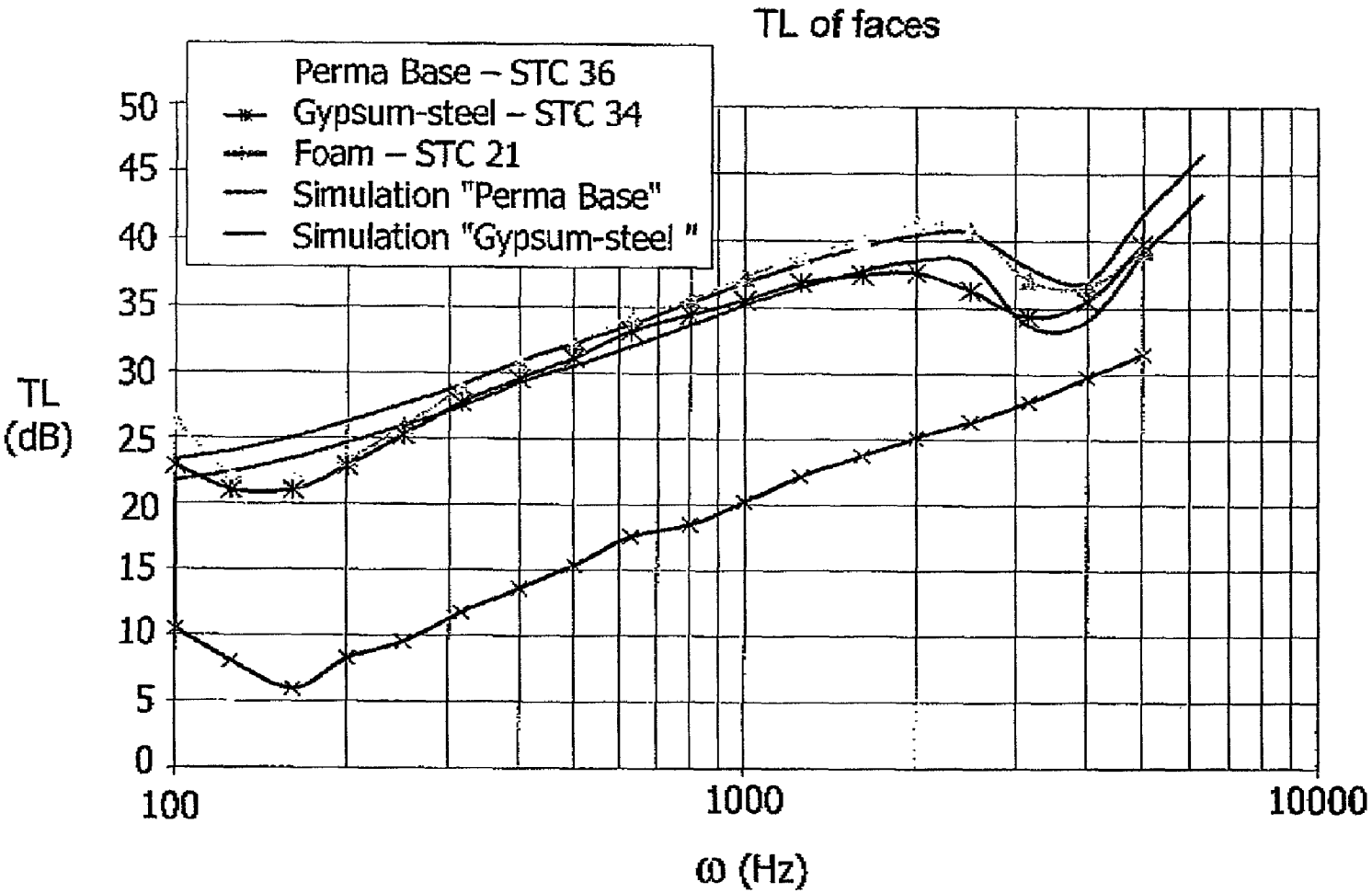
FIG. 7 is a graph of transmission loss versus frequency for several types of acoustic panels, comparing some simulations and some experimental data.

FIG. 7 shows the transmission loss of single faces that could be used in making an acoustic panel assembly. The "Perma Base" sample refers to a face made of a mixture of concrete and polystyrene which is available in the field of construction. The gypsum-steel face was a face of ½ inch of gypsum with an adhered steel sheet of 0.030 inch thickness. The "Foam" face refers to a rigid porous material furnished by INIVEX Composites, and is a light material.

Figure 8:
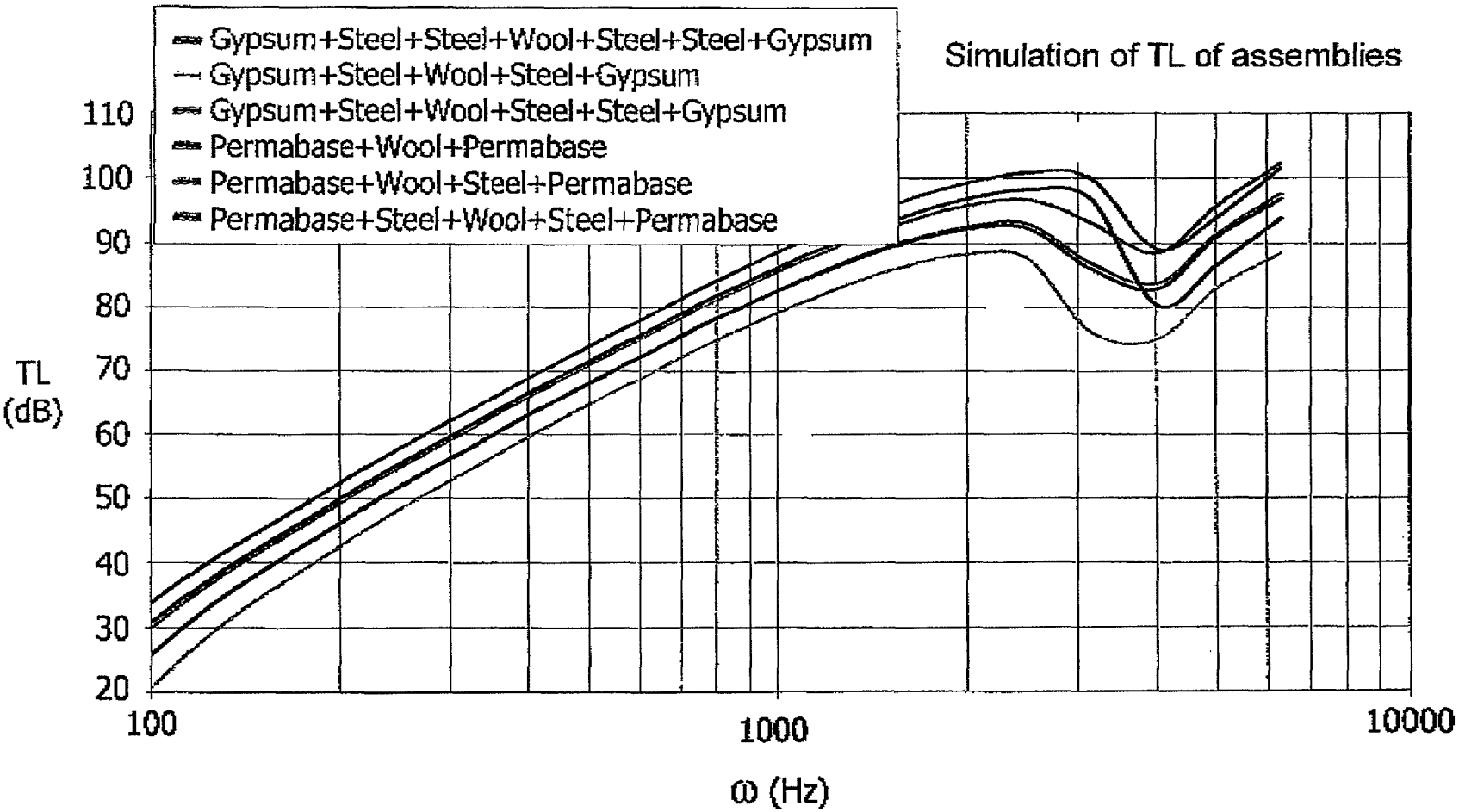
FIG. 8 is a graph of transmission loss versus frequency for several types of acoustic panel assemblies, based on simulations.
Figure 9A:
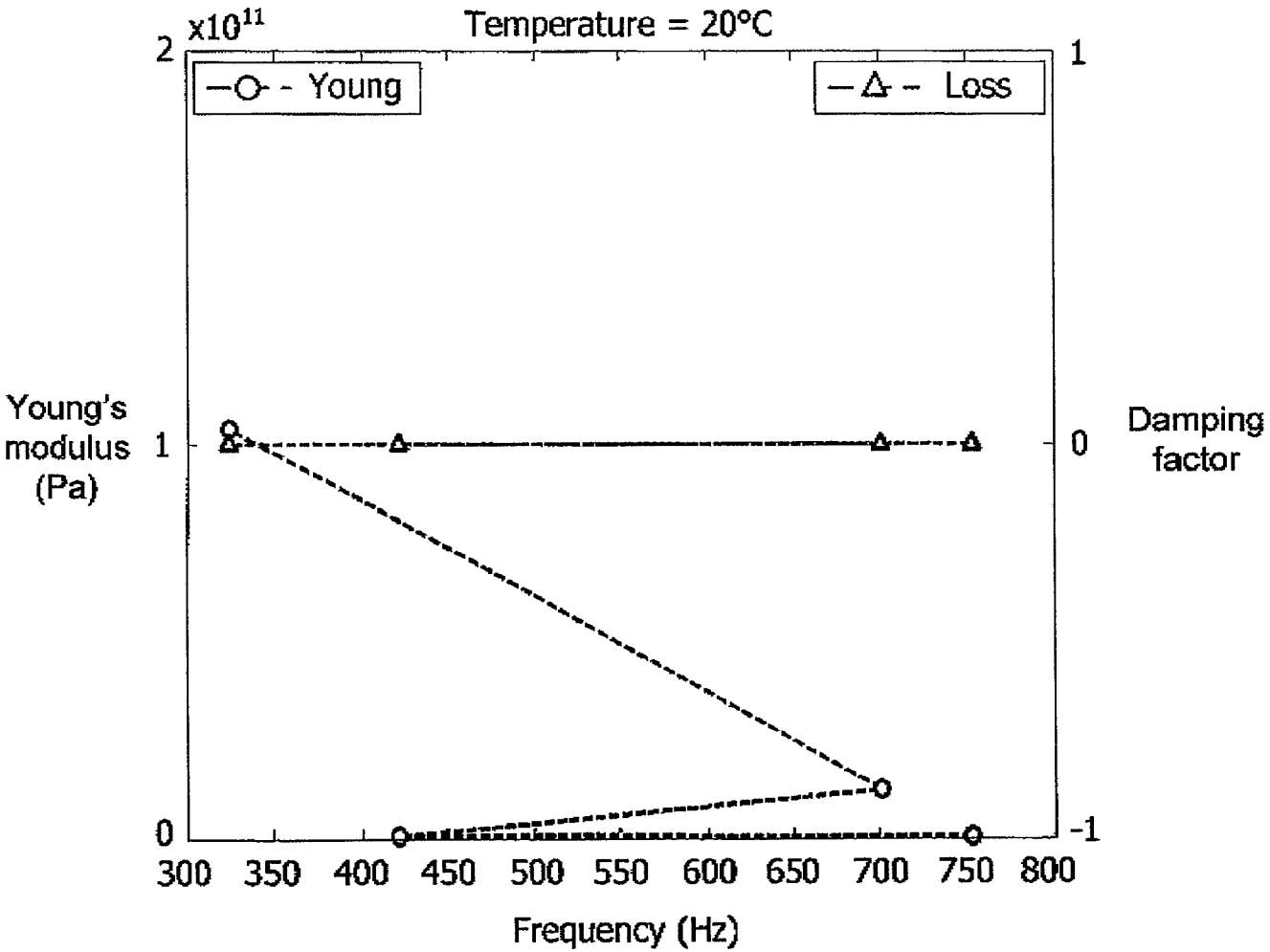
FIGS. 9*a-e* are graphs for the Oberst beam method for samples 1-5 of acoustic panels respectively.
Figure 9B:
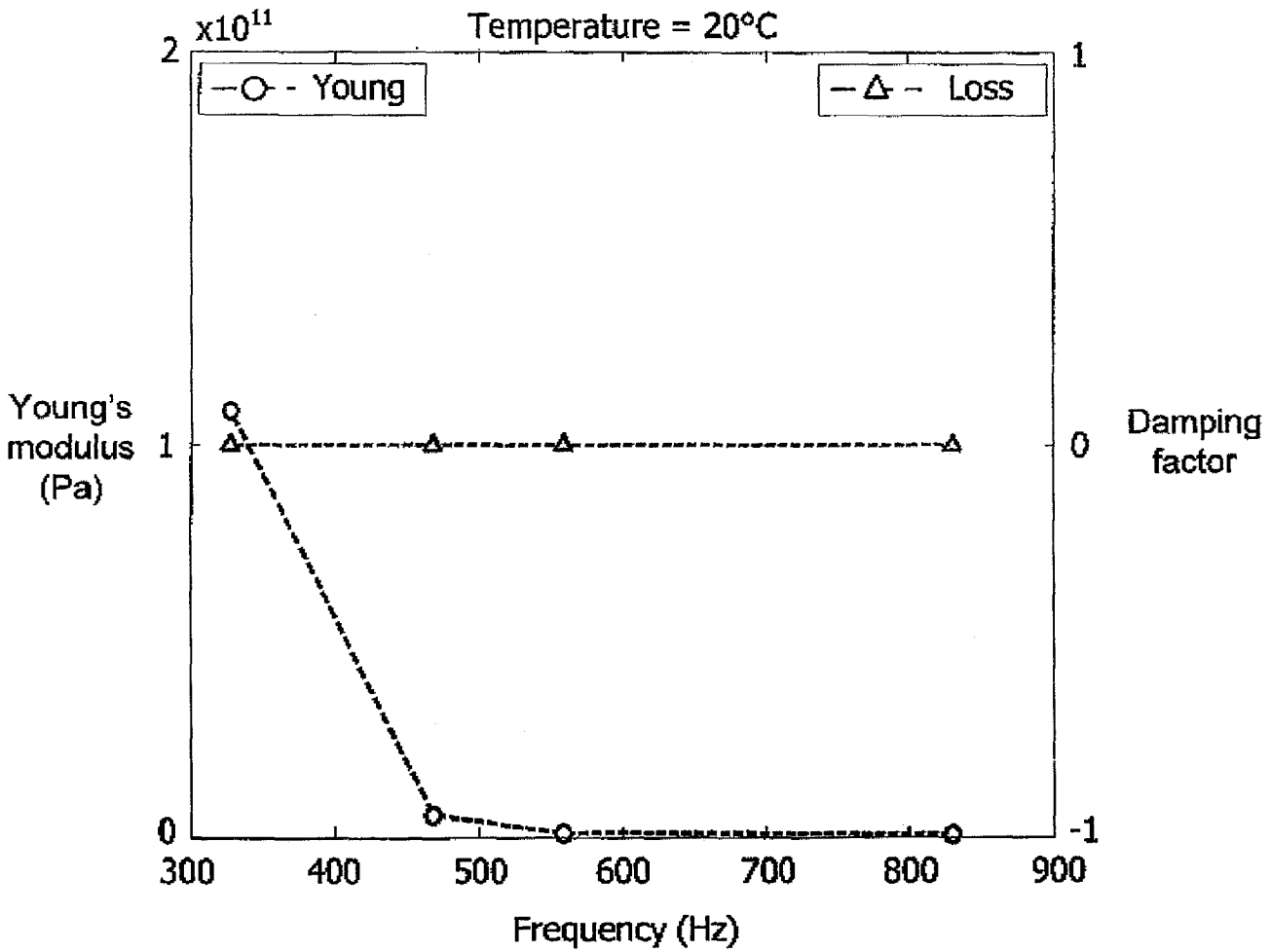
Figure 9C:
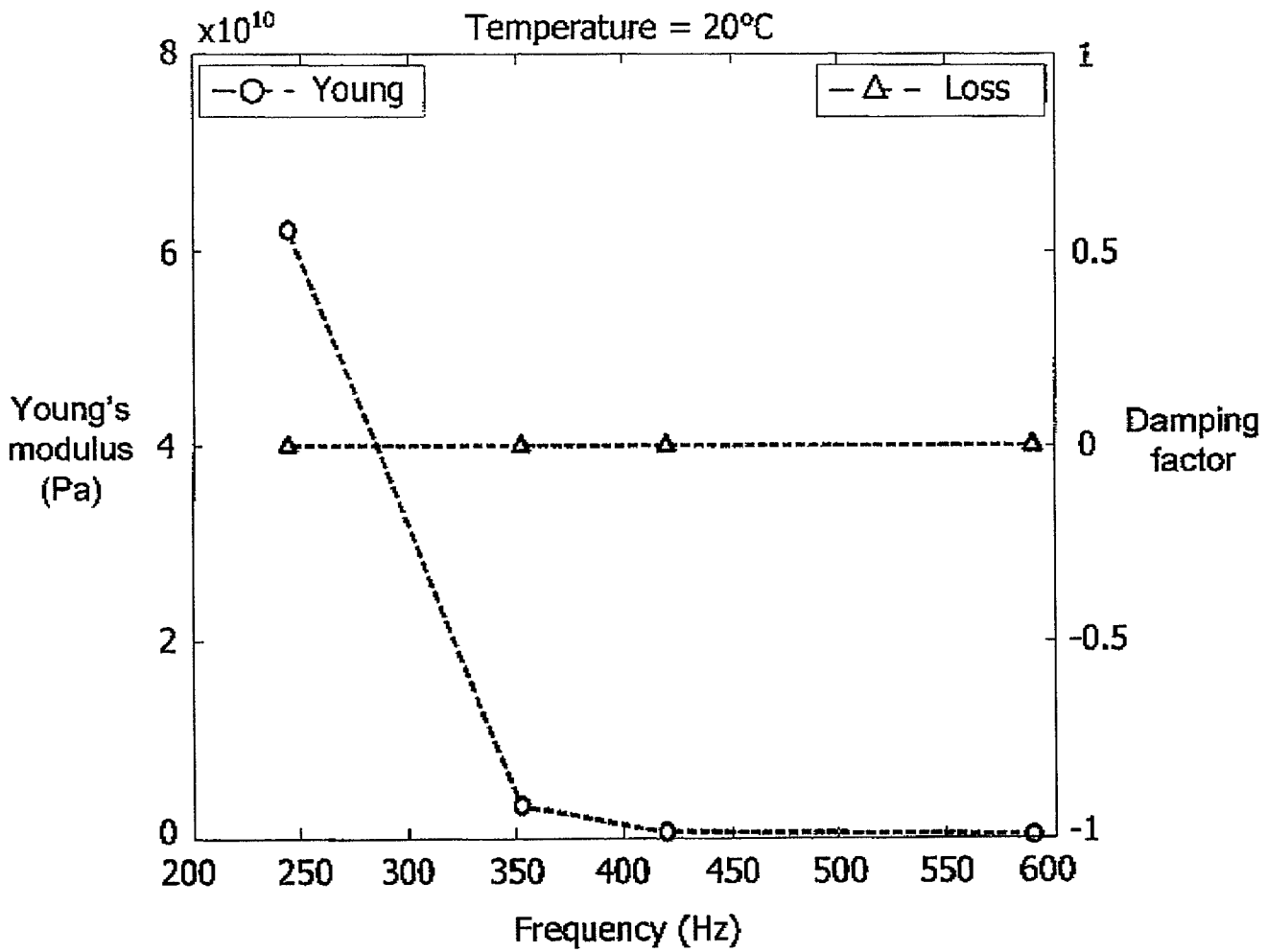
Figure 9D:
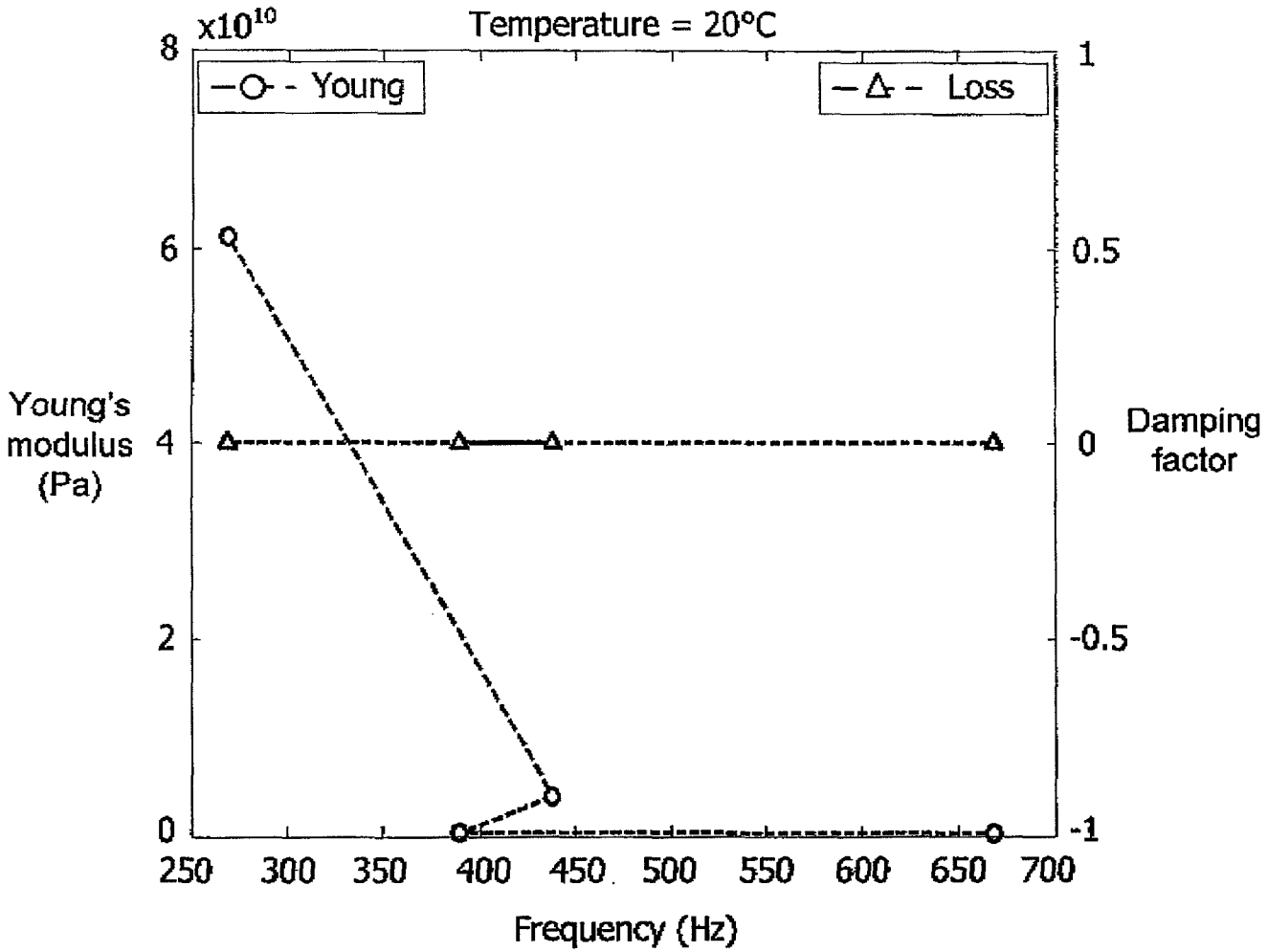
Figure 9E:
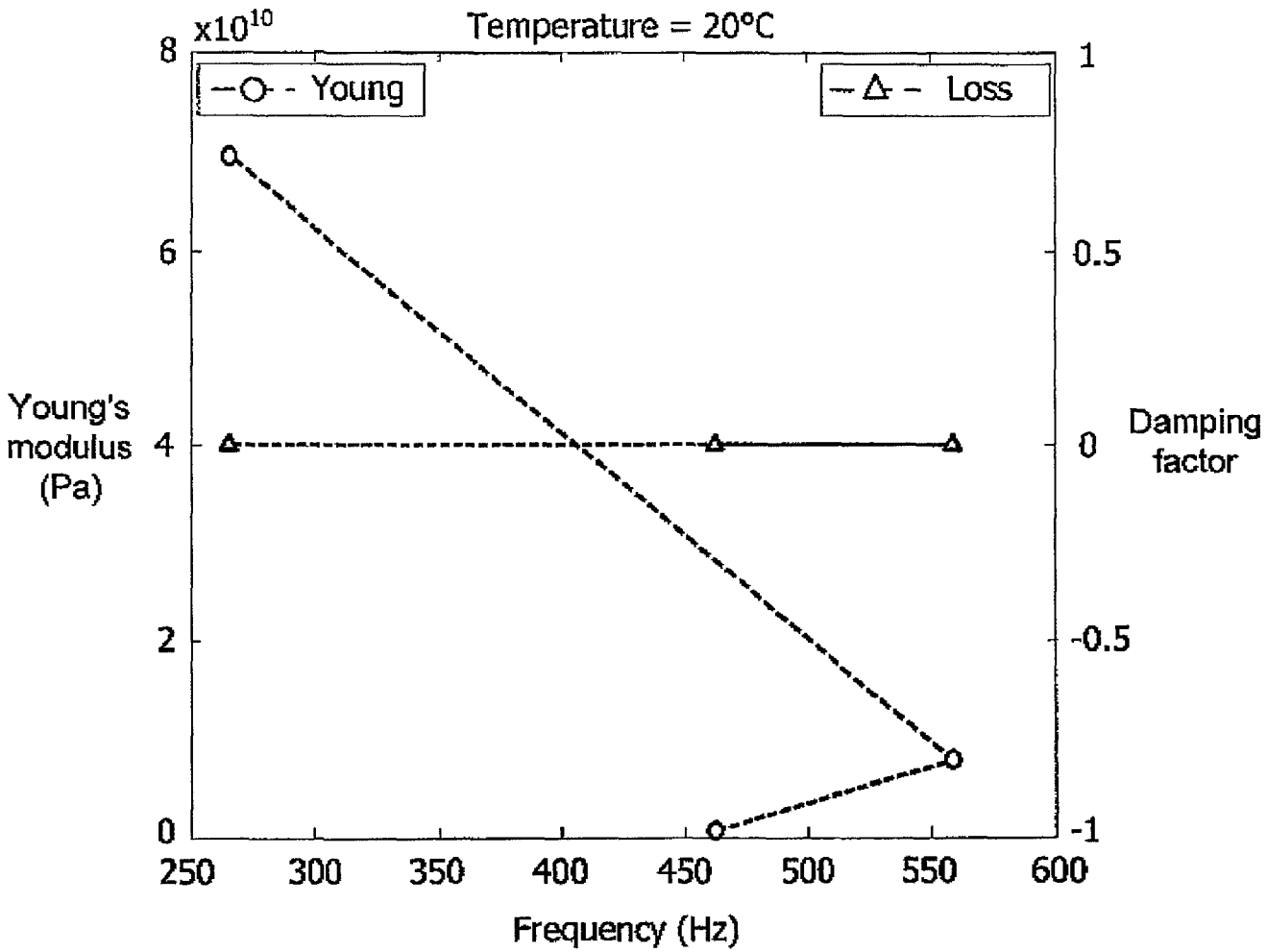

FIG. 8 shows the transmission loss of various panel assemblies composed of different combinations and types of faces. The assemblies include Roxul wool due to its low cost and its acoustic performance. One can see that a panel assembly of "Perma Base+Wool+Perma Base" has similar performance compared to the assembly of "Gypsum+Steel+Wool+Steel+Steel+Gypsum". Thus, Perma Base or other materials having similar performance, could be used to substitute gypsum or a gypsum-steel composite in an improved acoustic panel assembly. The principal parameters that influenced the favorable acoustic behavior of the "Perma Base" were its significant surface density and a relatively low rigidity.

With the results obtained from the initial part of the project, a search was performed to identify an improved material for an acoustic face with properties that would offer acoustic performance.

Sample materials 1-5 were identified as presenting efficient and cost-effective acoustic properties for making an acoustic face. The samples were all composed of a rigid polyurethane-based foam in which pieces of granite of different diameters were embedded. The outer surfaces of the faces were protected by cardboard sheets which added rigidity to the system and allowed a smooth finish.

| Sample No. | Weight (g) | Composition |
|---|---|---|
| 1 | 1170 | Polyurethane + rock powder |
| 2 | 1104 | Polyurethane + small marble aggregates (⅛ to ¼ inches in diameter) + rock powder |
| 3 | 1128 | Polyurethane + small marble aggregates (⅛ to ¼ inches in diameter) + large marble aggregates (¼ to ½ inches in diameter) |
| 4 | 1072 | Polyurethane + large marble aggregates (¼ to ½ inches in diameter) and rock powder |
| 5 | 912 | Polyurethane + large marble pieces (½ to ⅝ inches in diameter) + small marble aggregates (⅛ to ¼ inches in diameter) |

All of the samples tested had the following dimensions: 8 inches×8 inches×¾ inches thickness.

The Oberst beam method (ASTM E756-98) was used to determine the Young's modulus and the dampening coefficient of the samples, in a range of frequencies from 50 Hz to 5000 Hz without particular temperature limitations.

The measurements were realized in a GAUS chamber.

FIGS. 9*a* to 9*e* illustrate graphs for the Oberst beam method respectively for samples 1-5 and the following data were also obtained for the samples:

Sample 1

| Mode | Frequency (Hz) | Young's modulus (N/m$^2$) | Dampening coefficient |
|---|---|---|---|
| 1 | 322.5 | 1.03E+11 | 0.0543 |
| 2 | 487.45 | 5.98E+09 | 0.2682 |
| 3 | 557 | 9.95E+08 | 0.0593 |
| 4 | 790.75 | 5.22E+08 | 0.0594 |

Sample 2

| Mode | Frequency (Hz) | Young's modulus (N/m$^2$) | Dampening coefficient |
|---|---|---|---|
| 1 | 329.15 | 1.10E+11 | 0.0328 |
| 2 | 468.25 | 5.69E+09 | 0.0407 |
| 3 | 567.55 | 1.07E+09 | 0.0263 |
| 4 | 844.4 | 6.15E+08 | 0.0333 |

Sample 3

| Mode | Frequency (Hz) | Young's modulus (N/m$^2$) | Dampening coefficient |
|---|---|---|---|
| 1 | 244.35 | 6.22E+10 | 0.0272 |
| 2 | 352.95 | 3.30E+09 | 0.0752 |
| 3 | 431.8 | 6.31E+08 | 0.0456 |
| 4 | 602 | 3.19E+08 | 0.0268 |

Sample 4

| Mode | Frequency (Hz) | Young's modulus (N/m$^2$) | Dampening coefficient |
|---|---|---|---|
| 1 | 264.95 | 5.94E+10 | 0.0436 |
| 2 | 404.65 | 3.53E+09 | 0.101 |
| 3 | 426.5 | 5.00E+08 | 0.1015 |
| 4 | 670.9 | 3.22E+08 | 0.0554 |

Sample 5

| Mode | Frequency (Hz) | Young's modulus (N/m$^2$) | Dampening coefficient |
|---|---|---|---|
| 1 | 258.3 | 6.60E+10 | 0.0437 |
| 2 | 352.35 | 3.13E+09 | 1.282 |
| 3 | 457.65 | 6.73E+08 | 0.0581 |

It should be noted that the best acoustic performance was achieved by the sample having optimal spatial occupation of the aggregates while having an optimal amount of space between the aggregates to allow the polyurethane to spread out and fill the space. This enables a multitude of dense masses to be present in the face while not being physically interconnected. The aggregates can therefore vibrate freely with respect to each other and the polyurethane acts as an absorber between them. The rock powder did not allow the polyurethane to freely circulate to fill face volume and the very large aggregates did not maximize the density of the face.

The following table summarizes the average physical characteristics of the samples.

| Material | Young's modulus (N/m$^2$) | Dampening coefficient | Density (Kg/m$^3$) |
|---|---|---|---|
| Sample 1 | 1.36e+9 | 0.110 | 1273.05 |
| Sample 2 | 1.08e+9 | 0.033 | 1313.50 |
| Sample 3 | 8.05e+8 | 0.049 | 1342.06 |
| Sample 4 | 7.73e+9 | 0.086 | 1089.83 |
| Sample 5 | 8.09e+8 | 0.461 | 1275.43 |

Figure 10:
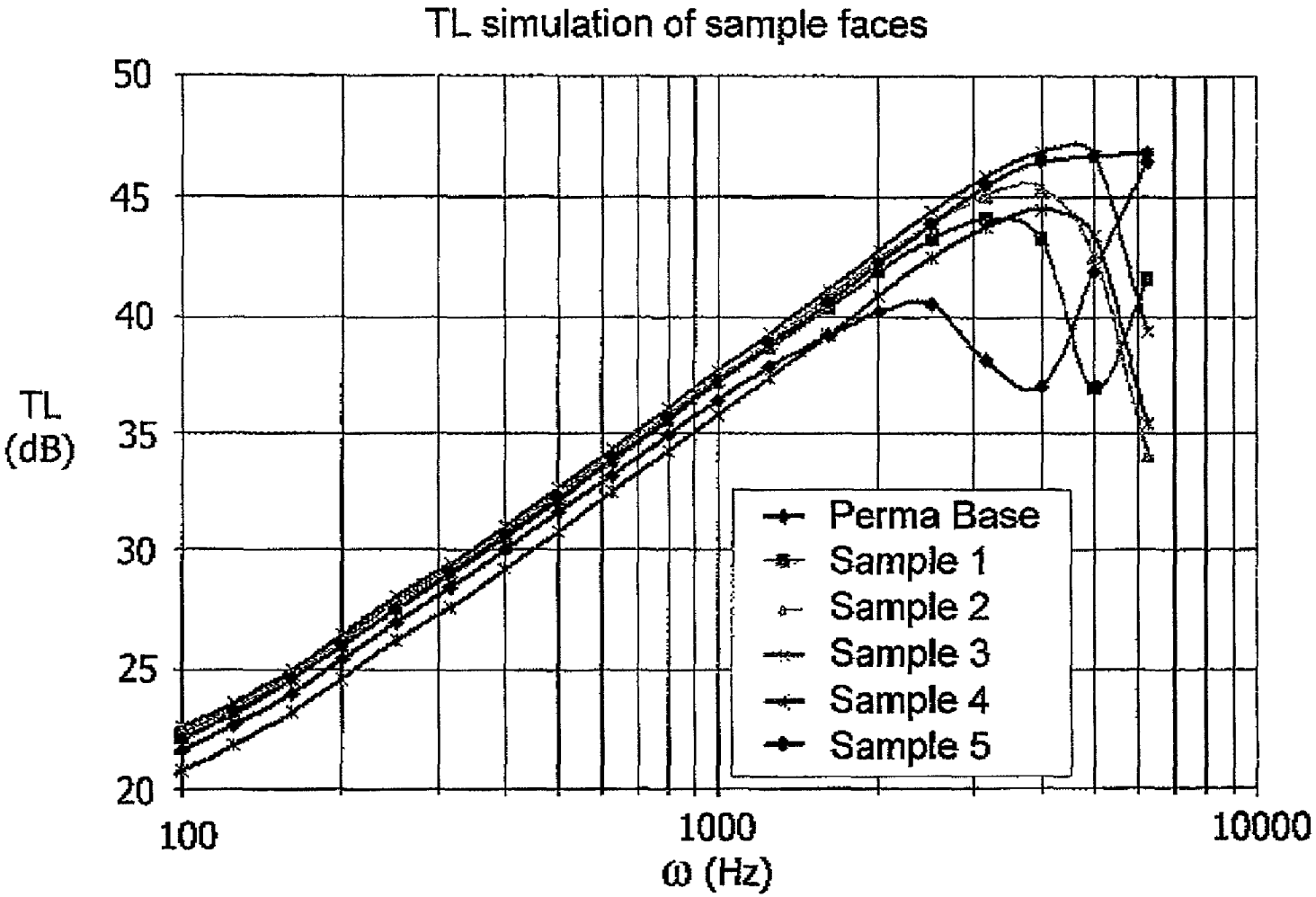
FIG. 10 is a graph of transmission loss versus frequency for samples 1-5 and Perma Base of acoustic panels, based on simulations.

FIG. 10 shows numerical simulations of the five above-identified samples along with Perma Base, with the software NOVA of Mecanum Inc. The results indicate that the samples compare relatively well in relation to Perma Base, with the exception of sample 4 at low and medium frequencies. In addition, the critical frequencies of the samples seemed to be higher than that of Perma Base, which would indicate improved acoustic performance. Furthermore, sample 3 showed the best acoustic performance. It is noted that this was the sample with the highest density and thus significantly benefited from the mass law as described above.

For the simulations illustrated in FIG. 11, the samples each had a nominal thickness of about 1.27 cm (½ inch), which corresponds to the real thickness of the samples produced later on.

Figure 11:
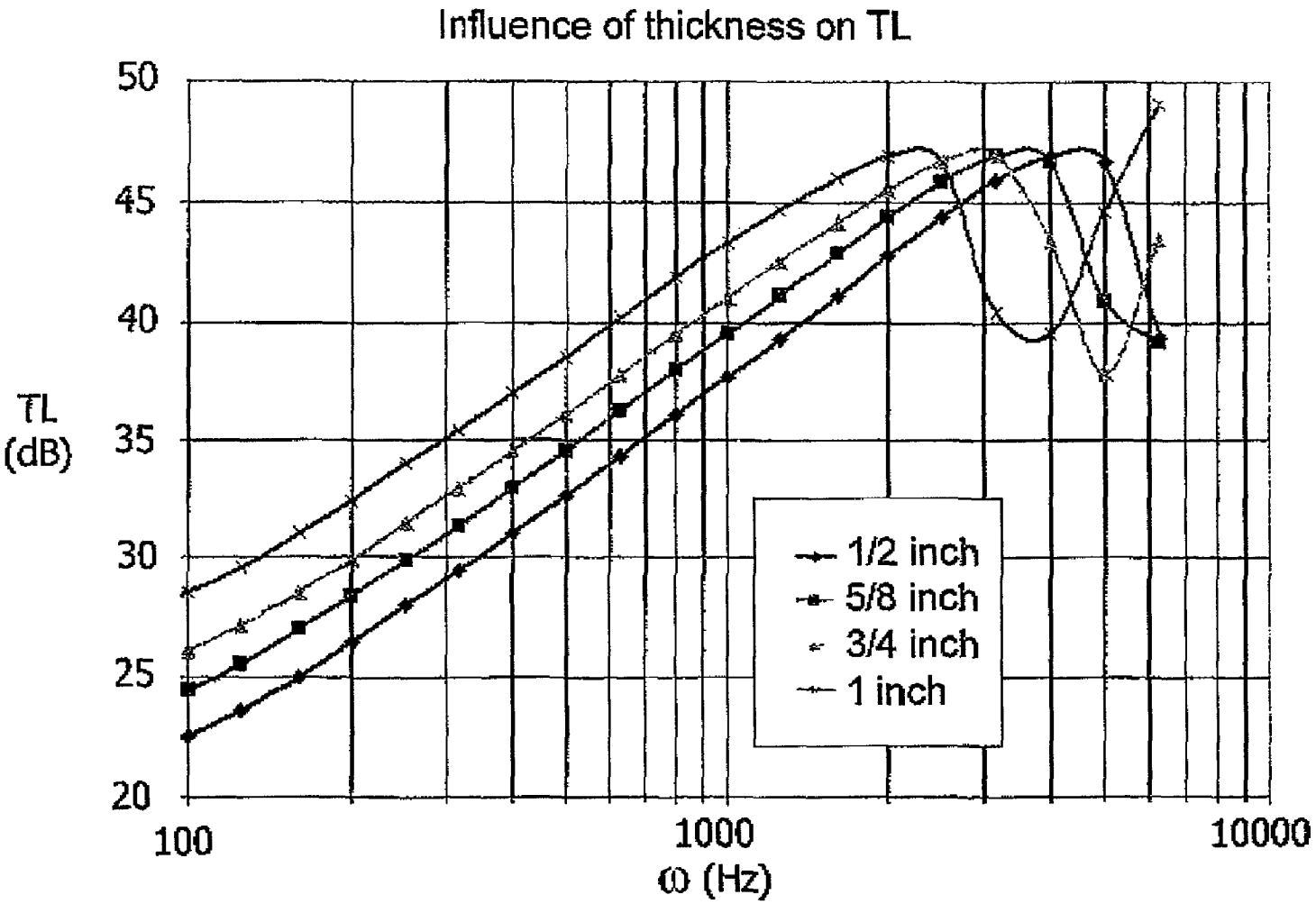
FIG. 11 is a graph of transmission loss versus frequency for sample 3 of the acoustic panel at different thicknesses, based on simulations.

FIG. 11 shows the influence of thickness on the acoustic performance of sample 3 in particular. It is noted that the larger the thickness, the better the acoustic performance at low frequencies, but this advantage is reduced by a lower critical frequency.

Figure 12:
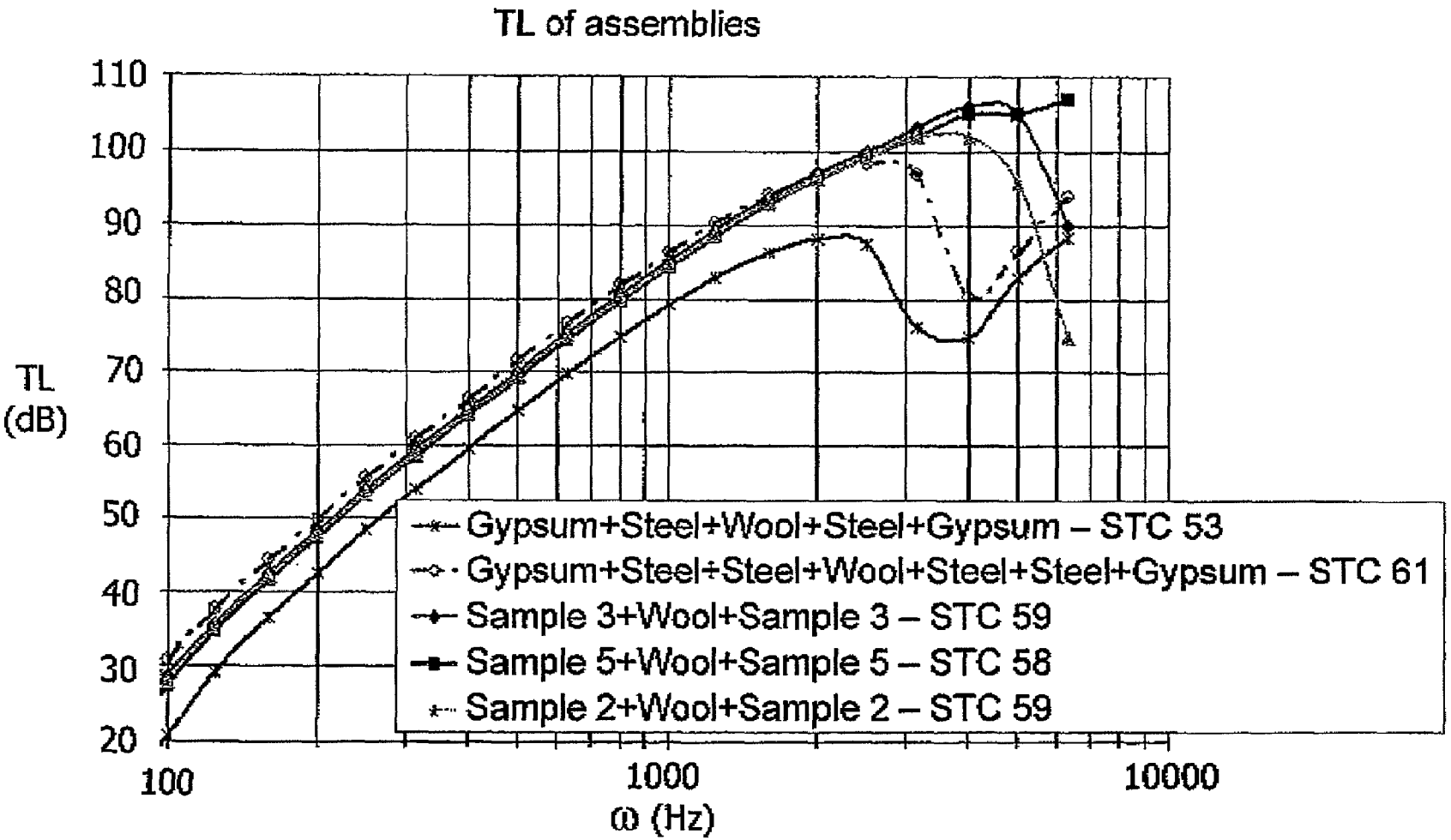
FIG. 12 is a graph of transmission loss versus frequency for symmetrical acoustic panel assemblies, respectively including panel samples 2, 3 and 5, and two different gypsum and steel arrangements, based on simulations.

FIG. 12 shows numerical simulations of acoustic panel assemblies including various different types of acoustic faces. The panel assemblies simulated according to samples 2, 3 and 5 showed increased performance compared to the classic assembly with gypsum and two sheets of steel. The potential gain in cost-effectiveness, especially of samples 2 and 3 with respect to the assembly with four steel sheets, is interesting. In addition, this cost-effectiveness could also be exploited by making asymmetrical assemblies. In the preceding simulations, the panels of gypsum or of the samples had a thickness of 1.27 cm (½ inch). By taking into account the sheets of steel that have a thickness of 0.762 cm, the panels of the assembly "Gypsum+Steel+Steel+Wool+Steel+Steel+Gypsum" have a total thickness of 2.85 cm, whereas the total thickness of the sample 3 assembly "No 3+Wool+No 3" is 2.54 cm. By opting for an asymmetrical assembly, in which the two panels have different thicknesses, it is possible to ameliorate the acoustic performance. Thus, one embodiment of the new panel assemblies could have a face of ½ inch, and the other face at ⅝ inch or ¾ inch, which would imply that the total thickness of the panel assembly would be 2.86 cm or 3.18 cm respectively.

Figure 13:
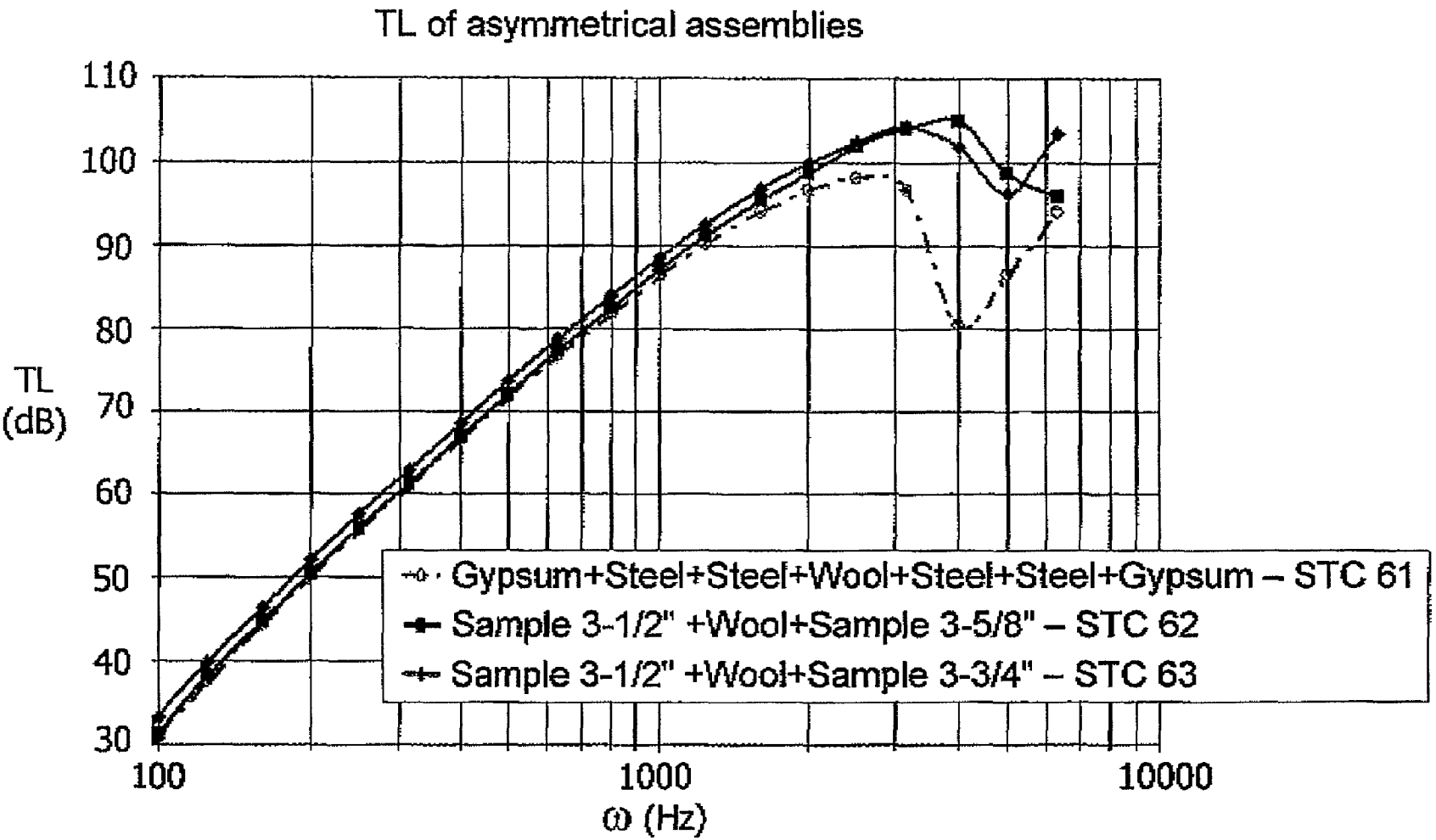
FIG. 13 is a graph of transmission loss versus frequency for asymmetrical acoustic panel assemblies, based on simulations.

FIG. 13 shows such asymmetric assemblies that are more acoustically performing than the known assembly with four steel sheets, and they also provide a cost savings.

Further Examples and Validation

Faces were produced by providing aggregates embedded in polyurethane foam according to the specifications of sample 3. Two acoustic panel assemblies were constructed, each having two spaced-apart opposed faces with a thickness of 1.27 cm. The difference between the two panel assemblies pertained to their respective frames. The first panel assembly included a standard Moderco™ Inc. frame, whereas the second included an uncoupled aluminium frame. Therefore, the acoustic effects of the frame's interconnections were able to be studied.

Figure 14:
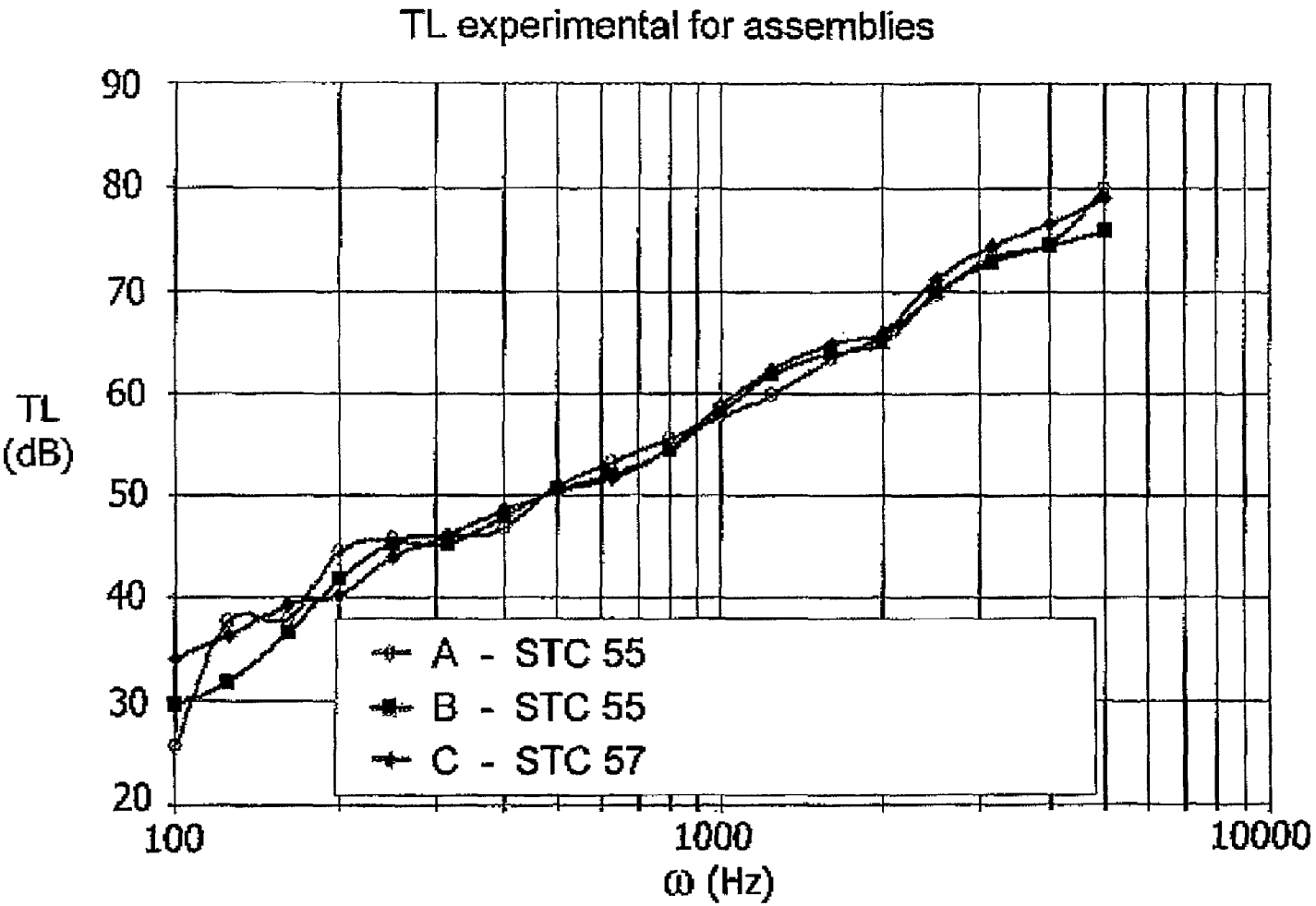
FIG. 14 is a graph of transmission loss versus frequency for acoustic panel assemblies A (traditional type including four steel sheets), B (including two sample 3 panels mounted within a frame in an uncoupled manner) and C (including two sample 3 panels mounted within a frame in a coupled manner), based on experimental data.

Referring to FIG. 14, the transmission loss versus frequency relationship of three panel assemblies was compared. The faces each had a thickness of about 1.27 cm.

Panel assembly A: Panel assembly A was a traditional type including four steel sheets and having a Sound Transmission Coefficient (STC) of 55.

Panel assembly B: Panel assembly B included two sample 3 panels as described above, which were mounted within a frame in an uncoupled manner. This panel assembly B had an STC of about 55.

Panel assembly C: Panel assembly C included two panels like assembly B, but they were mounted in the frame in a coupled manner. This panel assembly B had an STC of about 57.

The measurements for FIG. 14 were taken in the GAUS transmission loss laboratory, which included a reverberation chamber coupled to a semi anechoic chamber via the structure to be tested. The reverberation chamber had 7.5 m×6.2 m×3 m dimensions with a minimum frequency of 100 Hz. The reverberation time at 1000 Hz was 5.3 seconds. The free volume of the semi anechoic chamber was 6 m×7 m×3 m with a range of operational frequencies varying between 200 Hz and 80 kHz. The tested assemblies were inserted in the wall separating the two chambers. The reverberation chamber was totally uncoupled from the rest of the building to limit background noises. The transmission loss measurements were performed by using a method of measuring intensity, in conformity with the norm ISO 15186-1:2000. The reverberation chamber (local source) was provided with a six-speaker system. The white noise type signal sent to the speakers enable noise levels of about 120 dB in each of the octave bands from 100 to 4000 Hz. The global noise level in the reverberation chamber was about 127 dB. The average acoustic pressure in the reverberating field was measured by a microphone placed on a rotational antenna. In the anechoic chamber (local receptor) the average acoustic intensity was measured with an automated arm that displaced an intensity sensor equipped with two ½ inch microphones. These microphones were set in phase and polarized to 200V. A spacer of 12 mm was inserted between the two microphones to enable an analyzable frequency range between 100 and 5000 Hz. The calculation of acoustic power transmitted past the sample panel was performed via intensity measurements along the surface being tested. The automated arm took intensity measurements at 96 points over the sample being tested, to increase to repetitiveness at low frequencies and monitor the reactivity index over the entire measurement surface. The transmitted acoustic power in the anechoic chamber was obtained by multiplying the average measured intensity by the surface of the sample. The Transmission Loss (TL) of the tested sample was calculated by the following relationship:

$$TL = L_p - L_i - 6 - 10\log_{10}\left(\frac{Sm}{S}\right)(\text{dB})$$

where $L_p$ represents average acoustic pressure in the reverberating local;

$L_i$ indicates the average measured intensity over the surface in the reverberating local;

$S_m$ represents the total measurement area; and

S indicates the area of the tested sample.

Referring still to FIG. 14, it can be seen that the panel assemblies B and C present higher sound transmission loss compared to the traditional panel assembly A at low frequencies around 100 Hz. More particularly, panel assembly B presents higher sound transmission loss from about 100 Hz to about 110 Hz compared to assembly A; whereas panel assembly C presents higher sound transmission loss from about 100 Hz to about 125 Hz compared to assembly A. In addition, the coupled panel assembly C presented higher sound transmission loss over a variety of frequency ranges and had a higher STC of 57.

Between 125 and 250 Hz, steel has a fundamental mode of vibration which includes the resonance frequency for steel, which explains the relatively low TL for the gypsum-steel assembly. This is not the case for embodiments of the acoustic panel assembly of the present invention. The acoustic performance of the acoustic panel assembly is improved by optimizing at different frequency ranges. As the very composition of the panels may be asymmetrical, there may be no resonance frequency for the panel assembly. One can therefore have a lesser weight of the panel assembly of the present invention, to give a greater acoustic performance compared to the known panel assemblies, since there is no need to increase the TL at the 125-250 Hz frequency range as is needed for steel assemblies.

The coupled assembly C presented superior acoustic performance at low frequencies compared to the uncoupled assembly B. The reason for this may be that the uncoupling arrangement was not effective at low frequencies. The uncoupling was achieved at the sides of the plates which were glued to a thin piece of rubber. It seems that this thin piece of rubber may not have been able to ensure uncoupling at low frequencies.

It can be seen that the embodiments of the acoustic panel assembly according to the present invention (B and C) offered improved acoustic properties compared with the known gypsum-steel assembly.

Embodiments of the faces and the panel assemblies of the present invention may be employed in connection with various partition and suspension systems known in the art. Embodiments of polymer-coarse aggregate compositions may also be used to form various acoustic articles.

Although preferred embodiments of the present invention have been described in detail herein and illustrated in the accompanying drawings, it should be understood that the invention is not limited to these precise embodiments and that various changes and modifications may be effected therein without departing from what has actually been invented.

I claim:

1. An acoustic face comprising a cured solid foam-type polymer resin and coarse aggregates embedded within the solid foam-type polymer resin, wherein the coarse aggregates have a density greater than the density of the polymer resin, wherein the coarse aggregates are embedded within the polymer resin when the latter is in a flowable form prior to curing such that the acoustic face is an integral one-piece structure and wherein the foam-type polymer resin fills the interstitial space between the coarse aggregates providing flexibility.

2. The acoustic face of claim 1, wherein the coarse aggregates are sized between about 3 mm and about 13 mm.

3. The acoustic face of claim 1, wherein the coarse aggregates are sized between about 3 mm and about 25.4 mm.

4. The acoustic face of claim 1, wherein the coarse aggregates have a range of different sizes.

5. The acoustic face of claim 1, wherein the coarse aggregates are sized to at most the thickness of the acoustic face.

6. The acoustic face of claim 1, wherein the coarse aggregates are spherical, semi-spherical, square or semi-square, or a combination thereof.

7. The acoustic face of claim 1, wherein the coarse aggregates are present in over about 80 wt % relative to the overall weight of the face.

8. The acoustic face of claim 1, wherein the coarse aggregates are present in over 90 wt % relative to the overall weight of the face.

9. The acoustic face of claim 1, wherein the coarse aggregates are present in up to about 96 wt % relative to the overall weight of the face.

10. The acoustic face of claim 1, wherein the coarse aggregates are distributed randomly and evenly within the polymer resin.

11. The acoustic face of claim 1, wherein the coarse aggregates are mineral based or metal based or a combination thereof.

12. The acoustic face of claim 1, wherein the coarse aggregates comprise marble, granite, limestone or quarry stones, or a mixture thereof.

13. The acoustic face of claim 1, wherein the foam-type polymer is polyurethane.

14. The acoustic face of claim 1, where the face is sized to have dimensions including a thickness of about ⅜ inch to about 1 inch, a length of about 24 inches to about 54 inches, and a width of about 1 foot to about 30 feet.

15. The acoustic face of claim 1, further comprising a connector having an end embedded within the foam-type solid polymer resin.

16. The acoustic face of claim 15, wherein the end of the connector extends into the foam-type solid polymer resin at an oblique angle relative to a surface of the acoustic face.

17. An acoustic panel assembly comprising:

at least one frame defining a central opening; and a pair of the acoustic faces as defined in claim 1, mountable in opposed and spaced-apart relation to each other within the opening of one of the at least one frame.

18. The acoustic panel assembly of claim 17, further comprising mineral wool provided in between the pair of the acoustic faces.

19. The acoustic panel assembly of claim 18, wherein the mineral wool is rock wool.

20. The acoustic panel assembly of claim 17, further comprising a securing mechanism for securing at least one of the acoustic faces within the corresponding frame.

21. The acoustic panel assembly of claim 20, wherein the securing mechanism comprises a connector with first and second ends, the first end being connected to the frame and the second end being embedded within the solid polymer resin of the acoustic face.

22. The acoustic panel assembly of claim 21, wherein the second end comprises an anchor element extending into the polymer resin at an oblique angle relative to a surface of the acoustic faces.

23. The acoustic panel assembly of claim 21, wherein the first end extends along an edge of the face, the second end extends along a flat surface of the face.

24. The acoustic panel assembly of claim 17, wherein the at least one frame comprises two frames and the panel assembly further comprises a mounting mechanism for mounting the two frames together in coplanar relation.

25. The acoustic panel assembly of claim 17, wherein each frame is composed of metal.

26. The acoustic panel assembly of claim 17, wherein the acoustic faces of at least one pair have different thicknesses to thereby provide an asymmetrical acoustic panel assembly.

27. The acoustic panel assembly of claim 17, presenting a STC of at least about 53.

28. The acoustic panel assembly of claim 27, presenting a STC of about 55 to about 57.

29. The acoustic panel assembly of claim 17, wherein each of the frames has a rectangular shape such that each opening has a rectangular shape, and each of the corresponding acoustic faces is shaped to completely cover the corresponding opening.

30. The acoustic panel assembly of claim 17, used in conjunction with at least one other acoustic panel assembly, to form a mobile partition.

31. An acoustic face comprising a solid polymer resin and coarse aggregates embedded within the solid polymer resin, wherein the coarse aggregates have a density greater than the density of the polymer resin and wherein the coarse aggregates are present in over about 80 wt % relative to the overall weight of the face.

* * * * *